US009783758B2

(12) United States Patent
Akao

(10) Patent No.: US 9,783,758 B2
(45) **Date of Patent: *Oct. 10, 2017**

(54) LUBRICATING OIL COMPOSITION FOR TIMEPIECE AND TIMEPIECE

(71) Applicants: CITIZEN HOLDINGS CO., LTD., Tokyo (JP); CITIZEN WATCH CO., LTD., Tokyo (JP)

(72) Inventor: Yuji Akao, Tokyo (JP)

(73) Assignee: CITIZEN WATCH CO., LTD., Tokyo (JP)

( * ) Notice: Subject to any disclaimer, the term of this patent is extended or adjusted under 35 U.S.C. 154(b) by 41 days.

This patent is subject to a terminal disclaimer.

(21) Appl. No.: 14/760,816

(22) PCT Filed: Jan. 14, 2014

(86) PCT No.: PCT/JP2014/050454

§ 371 (c)(1),
(2) Date: Jul. 14, 2015

(87) PCT Pub. No.: WO2014/115603

PCT Pub. Date: Jul. 31, 2014

(65) Prior Publication Data

US 2016/0002562 A1 Jan. 7, 2016

(30) Foreign Application Priority Data

Jan. 22, 2013 (JP) ..... 2013-009330

(51) Int. Cl.
*C10M 169/04* (2006.01)
*C10M 137/02* (2006.01)
(Continued)

(52) U.S. Cl.
CPC ..... *C10M 161/00* (2013.01); *C10M 141/10* (2013.01); *C10M 169/04* (2013.01);
(Continued)

(58) Field of Classification Search
CPC ..... C10M 169/044; C10M 169/04; C10M 141/10; C10M 2201/041; C10M 2201/066;
(Continued)

(56) References Cited

U.S. PATENT DOCUMENTS 3,174,931 A 3/1965 Matson et al.
3,239,464 A 3/1966 Matson et al.
(Continued)

FOREIGN PATENT DOCUMENTS

CN 1364190 A 8/2002
CN 1462320 A 12/2003
(Continued)

OTHER PUBLICATIONS

EIC structure search Jul. 2016.*
(Continued)

*Primary Examiner* — Pamela H Weiss
(74) *Attorney, Agent, or Firm* — Sughrue Mion, PLLC

(57) ABSTRACT

The lubricating oil composition for a timepiece according to the present invention contains a lubricant component (A) containing a base oil (A1), at least one antiwear agent (B) selected from a neutral phosphite ester (B-2), and an antioxidant (C), and is characterized in that the total acid number of the composition is not more than 0.8 mgKOH/g, the antiwear agent (B) is contained in an amount of 0.1 to 15 parts by mass based on 100 parts by mass of the lubricant component (A), and the antioxidant (C) is contained in an amount of 0.01 to 3 parts by mass based on 100 parts by mass of the lubricant component (A).

14 Claims, 1 Drawing Sheet

(51) Int. Cl.
*C10M 161/00* (2006.01)
*C10M 141/10* (2006.01)

(52) U.S. Cl.
CPC . *C10M 2201/041* (2013.01); *C10M 2201/066* (2013.01); *C10M 2203/1025* (2013.01); *C10M 2205/026* (2013.01); *C10M 2205/0285* (2013.01); *C10M 2205/046* (2013.01); *C10M 2207/0406* (2013.01); *C10M 2207/1285* (2013.01); *C10M 2207/2835* (2013.01); *C10M 2209/062* (2013.01); *C10M 2209/084* (2013.01); *C10M 2209/0866* (2013.01); *C10M 2209/108* (2013.01); *C10M 2209/1026* (2013.01); *C10M 2209/1085* (2013.01); *C10M 2213/062* (2013.01); *C10M 2215/064* (2013.01); *C10M 2215/221* (2013.01); *C10M 2215/223* (2013.01); *C10M 2223/04* (2013.01); *C10M 2223/041* (2013.01); *C10M 2223/049* (2013.01); *C10N 2210/01* (2013.01); *C10N 2220/021* (2013.01); *C10N 2220/082* (2013.01); *C10N 2230/06* (2013.01); *C10N 2240/06* (2013.01); *C10N 2250/10* (2013.01)

(58) Field of Classification Search
CPC ..... C10M 2213/062; C10M 2205/026; C10M 2205/046; C10M 2205/0285; C10M 2207/2835; C10M 2209/1026; C10M 2207/0406; C10M 2209/1085; C10M 2209/062; C10M 2209/0866; C10M 2209/084; C10M 2223/041; C10M 2223/04; C10M 2215/064; C10M 2215/223; C10M 2223/049; C10M 161/00; C10M 2207/1285; C10M 2209/108; C10N 2220/082; C10N 2220/021; C10N 2240/06; C10N 2230/06; C10N 2220/00
See application file for complete search history.

(56) References Cited

U.S. PATENT DOCUMENTS 3,318,811 A * 5/1967 Conradi ..... C07C 29/70 508/228
5,186,852 A 2/1993 Ishida et al.
8,741,820 B2 * 6/2014 Akao ..... C10M 169/044 508/110
2003/0050197 A1 * 3/2003 Akao ..... C10M 169/04 508/280
2003/0109387 A1 6/2003 Akao et al.
2003/0162870 A1 * 8/2003 Kimura ..... C08K 5/523 524/127
2005/0014658 A1 * 1/2005 Akao ..... C10M 169/00 508/280
2008/0220999 A1 9/2008 Chase et al.
2011/0077178 A1 * 3/2011 Chase ..... C10M 133/02 508/185
2011/0257053 A1 * 10/2011 Akao ..... C10M 169/044 508/100
2011/0306530 A1 * 12/2011 Manabe ..... C10M 137/04 508/287
2012/0028861 A1 * 2/2012 Douglas ..... C10M 137/04 508/423
2015/0337233 A1 11/2015 Akao

FOREIGN PATENT DOCUMENTS

CN 1578826 A 2/2005
CN 1715381 A 1/2006
EP 0387979 A1 9/1990
EP 0 612 837 A1 8/1994
JP 2003192919 A * 7/2003
NL EP 0612837 A1 * 8/1994 ..... C10M 169/04
WO WO 9620263 A1 * 7/1996 ..... C10M 169/04
WO 01/59043 A1 8/2001
WO 2008/109523 A1 9/2008
WO 2014/115602 A1 7/2014

OTHER PUBLICATIONS

International Search Report of PCT/JP2014/050454 dated Feb. 18, 2014 [PCT/ISA/210].
Communication dated Jun. 22, 2016 from the European Patent Office in counterpart application No. 14743589.5.

* cited by examiner

[Fig. 1]
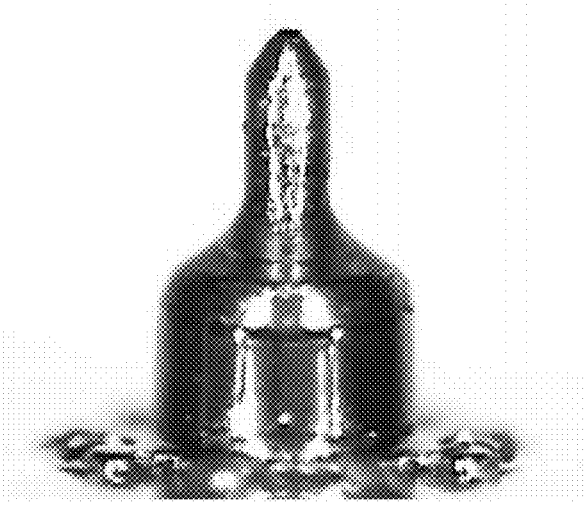
[Fig. 2]
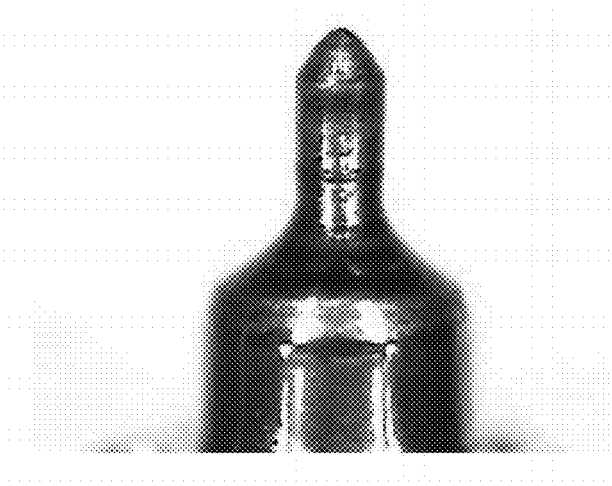

LUBRICATING OIL COMPOSITION FOR TIMEPIECE AND TIMEPIECE

CROSS REFERENCE TO RELATED APPLICATIONS

This application is a National Stage of International Application No. PCT/JP2014/050454, filed Jan. 14, 2014 (claiming priority based on Japanese Patent Application No. 2013-009330, filed Jan. 22, 2013), the contents of which are incorporated herein by reference in their entirety.

TECHNICAL FIELD

The present invention relates to a lubricating oil composition for a timepiece and a timepiece. More particularly, the present invention relates to a lubricating oil composition for a timepiece, which comprises a lubricant component containing a base oil, an antiwear agent and an antioxidant, and a timepiece having a sliding part to which the lubricating oil composition has been applied.

BACKGROUND ART

Timepieces are broadly classified into mechanical timepieces and electronic timepieces. The mechanical timepieces are timepieces that work by using, as a driving source, a mainspring encased in a barrel, and the electronic timepieces are timepieces that work by utilizing electric force. The mechanical and the electronic timepieces both display a time by combining a wheel train part, in which wheels to drive an hour hand, a minute hand and a second hand are assembled, with sliding parts, such as a lever.

In both timepieces, a lubricating oil composition is applied to the sliding parts in order to make smooth movement. As lubricating oil compositions for timepieces, a lubricating oil composition comprising at least 0.1 to 20% by weight of a viscosity index improver and 0.1 to 8% by weight of an antiwear agent in addition to a base oil composed of a polyol ester, a lubricating oil composition comprising at least 0.1 to 15% by weight of a viscosity index improver in addition to a base oil composed of a paraffin-based hydrocarbon oil having 30 or more carbon atoms, and a lubricating oil composition comprising at least an antiwear agent and an antioxidant in addition to a base oil composed of an ether oil, wherein the antiwear agent is a neutral phosphate ester and/or a neutral phosphite ester, and the content of the antiwear agent is 0.1 to 8% by weight are disclosed in Patent Literature 1.

CITATION LIST

Patent Literature

Patent Literature 1: WO 01/59043

SUMMARY OF INVENTION

Technical Problem

However, if such a conventional lubricating oil composition as described above is applied to sliding parts to operate a timepiece, a deposit such as worn powder or rust is formed in a sliding part to which great pressure is applied during sliding, and the color of the sliding part sometimes changes to dark brown. Thus, there is room for improvement in wear resistance and extreme pressure properties of the conventional lubricating oil compositions. Examples of the sliding parts to which great pressure is applied include sliding parts of mechanical timepieces and sliding parts of electronic timepieces designed so as to have, for example, many motors.

Solution to Problem

The lubricating oil composition for a timepiece according to the present invention is a lubricating oil composition comprising a lubricant component (A) containing at least one base oil (A1) selected from a polyol ester (A-1), a paraffin-based hydrocarbon oil (A-2) having 25 or more carbon atoms and an ether oil (A-3), at least one antiwear agent (B) selected from a neutral phosphate ester (B-1) and a neutral phosphite ester (B-2) and an antioxidant (C), and is characterized in that the total acid number of the composition is not more than 0.8 mgKOH/g, the antiwear agent (B) is contained in an amount of 0.1 to 15 parts by mass based on 100 parts by mass of the lubricant component (A), and the antioxidant (C) is contained in an amount of 0.01 to 3 parts by mass based on 100 parts by mass of the lubricant component (A), and the neutral phosphate ester (B-1) is represented by the following general formula (b-1) and the neutral phosphite ester (B-2) is represented by the following general formula (b-2):

(b-1)

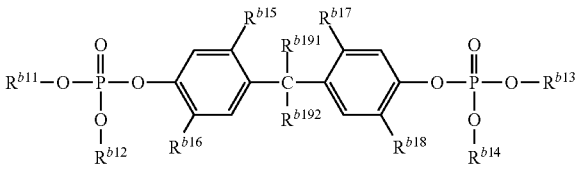

wherein $R^{b11}$ to $R^{b14}$ each independently represent an aliphatic hydrocarbon group of 10 to 16 carbon atoms, $R^{b15}$ to $R^{b18}$ each independently represent a straight-chain or branched alkyl group of 1 to 6 carbon atoms, $R^{b191}$ and $R^{b192}$ each independently represent a hydrogen atom or a straight-chain or branched alkyl group of 1 to 5 carbon atoms, and the total number of carbon atoms of $R^{b191}$ and $R^{b192}$ is 1 to 5, (b-2)

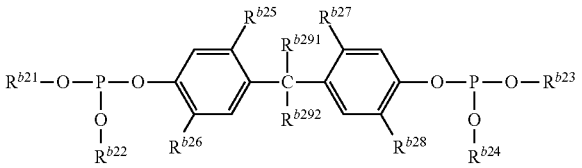

wherein $R^{b21}$ to $R^{b24}$ each independently represent an aliphatic hydrocarbon group of 10 to 16 carbon atoms, $R^{b25}$ to $R^{b28}$ each independently represent a straight-chain or branched alkyl group of 1 to 6 carbon atoms, $R^{b291}$ and $R^{b292}$ each independently represent a hydrogen atom or a straight-chain or branched alkyl group of 1 to 5 carbon atoms, and the total number of carbon atoms of $R^{b291}$ and $R^{b292}$ is 1 to 5.

Advantageous Effects of Invention

Even when the lubricating oil composition for a timepiece of the present invention is used to a sliding part to which great pressure is applied to operate a timepiece, formation of a deposit such as worn powder or rust can be suppressed, and change in color of the sliding part hardly occurs. That is to say, according to the lubricating oil composition for a timepiece of the present invention, even a mechanical timepiece or the like in which high pressure is applied to its sliding part can be favorably lubricated.

BRIEF DESCRIPTION OF DRAWINGS

FIG. 1 is a view to show a sliding part after a timepiece operating test is carried out with regard to Example 1-6-1.

FIG. 2 is a view to show a sliding part after a timepiece operating test is carried out with regard to Comparative Example 1-2.

DESCRIPTION OF EMBODIMENTS

The present invention is specifically described hereinafter.

[Lubricating Oil Composition for Timepiece]

The lubricating oil composition for a timepiece according to the present invention is a lubricating oil composition comprising a lubricant component (A) containing at least one base oil (A1) selected from a polyol ester (A-1), a paraffin-based hydrocarbon oil (A-2) having 25 or more carbon atoms and an ether oil (A-3), at least one antiwear agent (B) selected from a neutral phosphate ester (B-1) and a neutral phosphite ester (B-2), and an antioxidant (C), wherein the total acid number of the composition is not more than 0.8 mgKOH/g, preferably not more than 0.2 mgKOH/g.

When the total acid number is in this range, there is generally no change in consumption current, and a rise of viscosity and corrosion of timepiece members can be prevented, so that such a total acid number is preferable for a lubricating oil composition for a timepiece. If the components contained and their quantities used are within the ranges described below, the total acid number of the lubricating oil composition becomes not more than 0.8 mgKOH/g, preferably not more than 0.2 mgKOH/g. The total acid number is a value measured in accordance with JIS K2501-5.

<Lubricant Component (A)>

In the present invention, the "lubricant component" is used to generically refer to the aforesaid base oil and a solid lubricant. In the present invention, as the lubricant component (A), at least a base oil (A1) is used, and a solid lubricant (A2) can be used together with the base oil (A1). That is to say, the "lubricant component" in the present invention is the base oil (A1) itself or a combination of the base oil (A1) and the solid lubricant (A2).

In the present invention, the content of the base oil (A1) is usually not less than 30% by mass, preferably not less than 40% by mass, based on 100% by mass of the lubricant component (A). Here, the total amount of the base oil (A1) and the solid lubricant (A2) is 100% by mass of the lubricant component (A).

As embodiments of the lubricating oil composition, the following first embodiment and second embodiment can be mentioned.

For example, in the first embodiment of the present invention, the content of the base oil (A1) is more than 70% by mass, preferably not less than 80% by mass, more preferably not less than 90% by mass, particularly preferably 100% by mass, based on 100% by mass of the lubricant component (A).

By using the base oil (A1) in the above amount as the lubricant component (A) and by using an antiwear agent (B) and an antioxidant (C) together with such a lubricant component (A), the lubricating oil composition exhibits excellent wear resistance and extreme pressure properties. The lubricating oil composition of this first embodiment can be preferably used particularly for lubrication of sliding parts possessed by a timepiece, such as a wheel train part.

For example, in the second embodiment of the present invention, a solid lubricant (A2) is used as the lubricant component (A) together with the base oil (A1). Based on 100% by mass of the lubricant component (A), the content of the base oil (A1) is 30 to 70% by mass and the content of the solid lubricant (A2) is 70 to 30% by mass, it is preferable that the content of the base oil (A1) is 40 to 60% by mass and the content of the solid lubricant (A2) is 60 to 40% by mass, and it is more preferable that the content of the base oil (A1) is 40 to 52% by mass and the content of the solid lubricant (A2) is 60 to 48% by mass.

By using the base oil (A1) and the solid lubricant (A2) in the above amounts as the lubricant components (A) and by using an antiwear agent (B) and an antioxidant (C) together with such lubricant components (A), the lubricating oil composition has the aforesaid excellent wear resistance and extreme pressure properties and favorably functions as a lubricant particularly for a portion to which high pressure is applied. The lubricating oil composition of this second embodiment can be preferably used particularly for lubrication of sliding parts possessed by a timepiece, such as a mainspring encased in a barrel.

From the viewpoint of low-temperature properties, it is preferable that the lubricating oil composition of the second embodiment does not contain a thickener. The thickener is a component known as a basic component of grease.

The lubricating oil composition of the second embodiment can have, at ordinary temperature, fluidity of the same level as that of conventional grease containing a base oil, a thickener and an additive. However, this lubricating oil composition does not need to contain a thickener differently from the conventional grease. On this account, the lubricating oil composition of the second embodiment is not solidified even in a low-temperature environment (e.g., −30° C.). That is to say, the lubricating oil composition of the second embodiment can be applied to the same uses as those of the conventional grease, and is excellent in low-temperature properties.

« Base Oil (A1) »

The base oil (A1) for use in the present invention is at least one kind selected from a polyol ester (A-1), a paraffin-based hydrocarbon oil (A-2) having 25 or more carbon atoms and an ether oil (A-3).

Polyol Ester (A-1)

The polyol ester (A-1) is specifically an ester having a structure obtained by allowing a polyol having two or more hydroxyl groups in one molecule to react with one kind or plural kinds of monobasic acids or acid chlorides.

Examples of the polyols include neopentyl glycol, trimethylolpropane, pentaerythritol and dipentaerythritol.

Examples of the monobasic acids include saturated aliphatic carboxylic acids, such as acetic acid, propionic acid, butyric acid, isobutyric acid, valeric acid, pivalic acid, heptanoic acid, octanoic acid, nonanoic acid, decanoic acid, lauric acid, myristic acid and palmitic acid;

unsaturated aliphatic carboxylic acids, such as stearic acid, acrylic acid, propiolic acid, crotonic acid and oleic acid; and cyclic carboxylic acids, such as benzoic acid, toluic acid, naphthoic acid, cinnamic acid, cyclohexanecarboxylic acid, nicotinic acid, isonicotinic acid, 2-furoic acid, 1-pyrrolecarboxylic acid, monoethyl malonate and ethyl hydrogenphthalate.

Examples of the acid chlorides include salts such as chlorides of the above monobasic acids.

Examples of products from them include neopentyl glycol/caprylic acid capric acid mixed ester, trimethylolpropane/valeric acid heptanoic acid mixed ester, trimethylolpropane/decanoic acid octanoic acid mixed ester, trimethylolpropane nonanoate, and pentaerythritol/haptanoic acid capric acid mixed ester.

The polyol ester (A-1) is preferably a polyol ester having 3 or less hydroxyl groups, and is more preferably a complete ester having no hydroxyl group at a molecular end.

The kinematic viscosity of the polyol ester (A-1) is preferably not more than 3000 cSt at −30° C., and is more preferably not more than 1500 cSt at −30° C.

Paraffin-Based Hydrocarbon Oil (A-2)

The paraffin-based hydrocarbon oil (A-2) is composed of an α-olefin polymer of 25 or more carbon atoms, preferably 30 to 50 carbon atoms. Here, the number of carbon atoms of the paraffin-based hydrocarbon oil (A-2) can be determined by measuring a number-average molecular weight by gel permeation chromatography (GPC) and calculating the number from the measured value.

The α-olefin polymer of 25 or more carbon atoms is a polymer or copolymer of one or more kinds selected from ethylene and α-olefins of 3 to 18 carbon atoms, and is a polymer or copolymer having 25 or more carbon atoms. Specific examples thereof include a trimer of 1-decene, a trimer of 1-undecene, a trimer of 1-dodecene, a trimer of 1-tridecene, a trimer of 1-tetradecene and a copolymer of 1-hexene and 1-pentene.

The kinematic viscosity of the paraffin-based hydrocarbon oil (A-2) is preferably not more than 3000 cSt at −30° C., and is more preferably not more than 1500 cSt at −30° C.

Examples of such paraffin-based hydrocarbon oils (A-2) include products manufactured by Chevron Phillips Chemical Company, Exxon Mobil Chemical Company, Ineos Oligomers, Chemtura Corporation and Idemitsu Kosan Co., Ltd.

Ether Oil (A-3)

The ether oil (A-3) is preferably an ether oil represented by the following general formula (a-3). Since such an ether oil has no hydroxyl group at a molecular end, it is excellent in moisture absorption resistance.

$$R^{a31}\text{—}(\text{—}O\text{—}R^{a33}\text{—})_n\text{—}R^{a32} \quad \text{(a-3)}$$

In the formula (a-3), $R^{a31}$ and $R^{a32}$ are each independently an alkyl group of 1 to 18 carbon atoms or a monovalent aromatic hydrocarbon group of 6 to 18 carbon atoms.

Examples of the alkyl groups of 1 to 18 carbon atoms include methyl group, ethyl group, n-propyl group, isopropyl group, n-butyl group, isobutyl group, sec-butyl group, t-butyl group, n-pentyl group, isopentyl group, t-pentyl group, neopentyl group, n-hexyl group, isohexyl group, heptyl group, octyl group, nonyl group, decyl group, undecyl group, dodecyl group, tridecyl group, tetradecyl group, pentadecyl group, hexadecyl group, heptadecyl group and octadecyl group.

Examples of the monovalent aromatic hydrocarbon groups of 6 to 18 carbon atoms include phenyl group, tolyl group, xylyl group, benzyl group, phenethyl group, 1-phenylethyl group and 1-methyl-1-phenylethyl group.

$R^{a33}$ is an alkylene group of 1 to 18 carbon atoms or a divalent aromatic hydrocarbon group of 6 to 18 carbon atoms.

Examples of the alkylene groups of 1 to 18 carbon atoms include methylene group, ethylene group, propylene group and butylene group.

Examples of the divalent aromatic hydrocarbon groups of 6 to 18 carbon atoms include phenylene group and 1,2-naphthylene group.

n is an integer of 1 to 5.

As the base oils (A1) for use in the present invention, the polyol esters (A-1) may be used singly or may be used in combination of two or more kinds. The same shall apply to the paraffin-based hydrocarbon oils (A-2) having 25 or more carbon atoms and to the ether oils (A-3). Further, one or more kinds of the polyol esters (A-1) and one or more kinds of the paraffin-based hydrocarbon oils (A-2) having 25 or more carbon atoms may be used in combination. The same shall apply to the paraffin-based hydrocarbon oils (A-2) having 25 or more carbon atoms and the ether oils (A-3), and to the polyol esters (A-1) and the ether oils (A-3). Furthermore, one or more kinds of the polyol esters (A-1), one or more kinds of the paraffin-based hydrocarbon oils (A-2) having 25 or more carbon atoms and one or more kinds of the ether oils (A-3) may be used in combination.

In the case where high stability is required for the lubricating oil composition, such as a case where a plastic member is used in the vicinity of a sliding part, the paraffin-based hydrocarbon oil (A-2) having 25 or more carbon atoms is preferably used. The compatibility is increasing in order of the paraffin-based hydrocarbon oil (A-2), the ether oil (A-3) and the polyol ester (A-1), and therefore, depending upon the components for use in the lubricating oil composition, solubility of those components and low-temperature operating properties of the lubricating oil composition may be controlled by appropriately mixing these base oils.

« Solid Lubricant (A2) »

The solid lubricant (A2) is a substance capable of reducing sliding resistance when it is in a solid state. The solid lubricant (A2) is, for example, powdery, and therefore, even when a lubricating oil composition containing the solid lubricant (A2) is placed in a low-temperature environment (e.g., −30° C.), the composition is prevented from being solidified and has given fluidity.

Accordingly, not only at ordinary temperature but also at low temperatures, the lubricating oil composition containing the base oil (A1) and the solid lubricant (A2) can be applied to uses to which conventional grease has been applied. In particular, the above lubricating oil composition can be preferably applied to sliding parts (e.g., mainspring in barrel) in a timepiece.

Examples of the solid lubricants (A2) include transition metal sulfides, such as molybdenum disulfide and tungsten disulfide; organomolybdenum compounds; fluororesins, such as polytetrafluoroethylene (PTFE), tetrafluoroethylene/perfluoroalkyl vinyl ether copolymer (PFA), tetrafluoroethylene/hexafluoropropylene copolymer (FEP), tetrafluoroethylene/ethylene copolymer (ETFE), polyvinylidene fluoride (PVDF) and polychlorotrifluoroethylene (PCTFE); and inorganic solid lubricants, such as graphite, hexagonal boron nitride, synthetic mica and talc.

Of these, preferable are fluororesins, transition metal sulfides and graphite, more preferable are PTFE, molybdenum disulfide and graphite, and particularly preferable is PTFE from the viewpoint of a balance between color tone and lubrication properties.

The mean particle diameter of the solid lubricant (A2) is preferably not more than 5 μm, more preferably 0.1 to 5 μm. A mean particle diameter of the above range is preferable from the viewpoints of dispersibility, non-precipitation properties and lubrication properties of the solid lubricant (A2). The mean particle diameter can be measured by, for example, a laser diffraction type particle size distribution measuring device.

<Antiwear Agent (B)>

The antiwear agent (B) used in the present invention is at least one selected from a neutral phosphate ester (B-1) and a neutral phosphite ester (B-2). The neutral phosphate ester (B-1) is represented by the following general formula (b-1), and the neutral phosphite ester (B-2) is represented by the following general formula (b-2).

Among sliding parts of a mechanical timepiece, there is a sliding part to which a high pressure of not less than 3800 $N/mm^2$ is applied, and if a conventional lubricating oil composition is used for this sliding part, a deposit such as worn powder or rust is formed, and the color of the sliding part sometimes changes to dark brown. The reason is thought to be that the conventional lubricating oil composition is manufactured suitably to a quartz type timepiece having low pressure resistance. Further, it is thought that such a phenomenon is also attributable to the fact that the material of the mechanical timepiece is an iron-based material differently from the quartz type timepiece whose material is phosphor bronze or the like.

On the other hand, the lubricating oil composition for a timepiece according to the present invention uses a specific antiwear agent (B), and therefore, the wear resistance and extreme pressure properties of the lubricating oil composition for a timepiece can be improved. That is to say, even when a timepiece is operated using the lubricating oil composition in a sliding part to which great pressure is applied during sliding, formation of a deposit such as worn powder or rust is suppressed, and color change of the sliding part hardly occurs. Thus, according to the lubricating oil composition, even a timepiece having a sliding part to which high pressure is applied can be favorably lubricated.

Examples of the straight-chain or branched alkyl groups of 1 to 6 carbon atoms include methyl group, ethyl group, n-propyl group, n-butyl group, n-pentyl group, n-hexyl group, isopropyl group, sec-butyl group, isobutyl group, t-butyl group, isopentyl group, t-pentyl group, neopentyl group and isohexyl group.

The neutral phosphate ester (B-1) has specific substituents at $R^{b15}$ to $R^{b18}$, and therefore, even when the lubricating oil composition is used in a sliding part to which great pressure is applied during sliding, wear resistance and extreme pressure properties can be improved. The reason is thought to be that if the neutral phosphate ester has specific substituents at $R^{b15}$ to $R^{b18}$, a film of the lubricating oil composition applied to the sliding part is strengthened.

Particularly when $R^{b15}$ and $R^{b17}$ are each a straight-chain alkyl group of 1 to 6 carbon atoms, preferably 1 to 3 carbon atoms, and $R^{b16}$ and $R^{b18}$ are each a branched alkyl group of 3 to 6 carbon atoms, preferably 3 to 4 carbon atoms, the effect to improve the aforesaid wear resistance and extreme pressure properties is further enhanced.

$R^{b191}$ and $R^{b192}$ each independently represent a hydrogen atom or a straight-chain or branched alkyl group of 1 to 5 carbon atoms.

Examples of the straight-chain or branched alkyl groups of 1 to 5 carbon atoms include methyl group, ethyl group, n-propyl group, n-butyl group, n-pentyl group, isopropyl group, sec-butyl group, isobutyl group, t-butyl group, isopentyl group, t-pentyl group and neopentyl group.

However, the total number of carbon atoms of $R^{b191}$ and $R^{b192}$ is 1 to 5. Therefore, when $R^{b191}$ is, for example, a hydrogen atom, $R^{b192}$ is a straight-chain or branched alkyl group of 1 to 5 carbon atoms, when $R^{b191}$ is, for example, a methyl group, $R^{b192}$ is a straight-chain or branched alkyl group of 1 to 4 carbon atoms, and when $R^{b191}$ is, for example, an ethyl group, $R^{b192}$ is a straight-chain or branched alkyl group of 2 to 3 carbon atoms.

It is more preferable that $R^{b191}$ is a hydrogen atom and $R^{b192}$ is a straight-chain or branched alkyl group of 1 to 5 carbon atoms, particularly because a film of the lubricating oil composition is further strengthened.

(b-1)

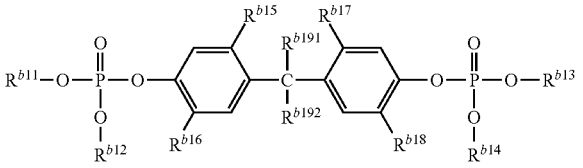

In the formula (b-1), $R^{b11}$ to $R^{b14}$ each independently represent an aliphatic hydrocarbon group of 10 to 16 carbon atoms.

The aliphatic hydrocarbon group of 10 to 16 carbon atoms may be a straight-chain, branched or cyclic aliphatic hydrocarbon group, and may be a saturated or unsaturated aliphatic hydrocarbon group. Specific examples of the aliphatic hydrocarbon groups of 10 to 16 carbon atoms preferably used include straight-chain alkyl groups, such as decyl group, undecyl group, dodecyl group, tridecyl group, tetradecyl group, pentadecyl group and hexadecyl group (cetyl group).

$R^{b15}$ to $R^{b18}$ each independently represent a straight-chain or branched alkyl group of 1 to 6 carbon atoms.

(b-2)

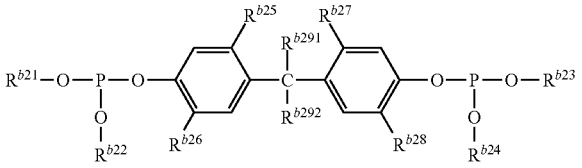

In the formula (b-2), $R^{b21}$ to $R^{b24}$ each independently represent an aliphatic hydrocarbon group of 10 to 16 carbon atoms.

The aliphatic hydrocarbon group of 10 to 16 carbon atoms may be a straight-chain, branched or cyclic aliphatic hydrocarbon group, and may be a saturated or unsaturated aliphatic hydrocarbon group. Specific examples of the aliphatic hydrocarbon groups of 10 to 16 carbon atoms preferably used include straight-chain alkyl groups, such as decyl group, undecyl group, dodecyl group, tridecyl group, tetradecyl group, pentadecyl group and hexadecyl group (cetyl group).

$R^{b25}$ to $R^{b28}$ each independently represent a straight-chain or branched alkyl group of 1 to 6 carbon atoms.

Examples of the straight-chain or branched alkyl groups of 1 to 6 carbon atoms include methyl group, ethyl group, n-propyl group, n-butyl group, n-pentyl group, n-hexyl group, isopropyl group, sec-butyl group, isobutyl group, t-butyl group, isopentyl group, t-pentyl group, neopentyl group and isohexyl group.

The neutral phosphite ester (B-2) has specific substituents at $R^{b25}$ to $R^{b28}$, and therefore, even when the lubricating oil composition is used in a sliding part to which great pressure is applied during sliding, wear resistance and extreme pressure properties can be improved. The reason is thought to be that if the neutral phosphite ester has specific substituents at $R^{b25}$ to $R^{b28}$, a film of the lubricating oil composition applied to the sliding part is strengthened.

Particularly when $R^{b25}$ and $R^{b27}$ are each a straight-chain alkyl group of 1 to 6 carbon atoms, preferably 1 to 3 carbon atoms, and $R^{b26}$ and $R^{b28}$ are each a branched alkyl group of 3 to 6 carbon atoms, preferably 3 to 4 carbon atoms, the effect to improve the aforesaid wear resistance and extreme pressure properties is further enhanced.

$R^{b291}$ and $R^{b292}$ each independently represent a hydrogen atom or a straight-chain or branched alkyl group of 1 to 5 carbon atoms.

Examples of the straight-chain or branched alkyl groups of 1 to 5 carbon atoms include methyl group, ethyl group, n-propyl group, n-butyl group, n-pentyl group, isopropyl group, sec-butyl group, isobutyl group, t-butyl group, isopentyl group, t-pentyl group and neopentyl group.

However, the total number of carbon atoms of $R^{b291}$ and $R^{b292}$ is 1 to 5. Therefore, when $R^{b291}$ is, for example, a hydrogen atom, $R^{b292}$ is a straight-chain or branched alkyl group of 1 to 5 carbon atoms, when $R^{b291}$ is, for example, a methyl group, $R^{b292}$ is a straight-chain or branched alkyl group of 1 to 4 carbon atoms, and when $R^{b291}$ is, for example, an ethyl group, $R^{b292}$ is a straight-chain or branched alkyl group of 2 to 3 carbon atoms.

It is more preferable that $R^{b291}$ is a hydrogen atom and $R^{b292}$ is a straight-chain or branched alkyl group of 1 to 5 carbon atoms, particularly because a film of the lubricating oil composition is further strengthened.

It is thought that the neutral phosphite ester (B-2) has higher structural stability when it is used in the lubricating oil composition, and therefore, the neutral phosphite ester (B-2) is still more preferably used.

As the antiwear agents (B) for use in the present invention, the neutral phosphate esters (B-1) may be used singly or may be used in combination of two or more kinds. The same shall apply to the neutral phosphite esters (B-2). Further, one or more kinds of the neutral phosphate esters (B-1) and one or more kinds of the neutral phosphite esters (B-2) may be used in combination.

The antiwear agent (B) is contained in an amount of 0.1 to 15 parts by mass, preferably 0.1 to 8 parts by mass, based on 100 parts by mass of the lubricant component (A). From the viewpoint of enhancement in wear resistance and extreme pressure properties, the antiwear agent is preferably contained in the above proportion.

<Another Antiwear Agent (B')>

The lubricating oil composition for a timepiece according to the present invention may further contain another antiwear agent (B').

Examples of such other antiwear agents (B') include:

neutral phosphate esters such as tricresyl phosphate, trixylenyl phosphate, trioctyl phosphate, trimethylolpropane phosphate, triphenyl phosphate, tris(nonylphenyl) phosphate, triethyl phosphate, tris(tridecyl) phosphate, tetraphenyl dipropylene glycol diphosphate, tetraphenyl tetra(tridecyl)pentaerythritol tetraphosphate, tetra(tridecyl)-4,4'-isopropylidene diphenyl phosphate, bis(tridecyl) pentaerythritol diphosphate, bis(nonylphenyl) pentaerythritol diphosphate, tristearyl phosphate, distearyl pentaerythritol diphosphate, tris(2,4-di-t-butylphenyl) phosphate, and a hydrogenated bisphenol A/pentaerythritol phosphate polymer; and neutral phosphite esters such as trioleyl phosphite, trioctyl phosphite, trimethylolpropane phosphite, triphenyl phosphite, tris(nonylphenyl) phosphite, triethyl phosphite, tris (tridecyl) phosphite, tetraphenyl dipropylene glycol diphosphite, tetraphenyl tetra(tridecyl)pentaerythritol tetraphosphite, tetra(tridecyl)-4,4'-isopropylidene diphenyl phosphite, bis(tridecyl)pentaerythritol diphosphite, bis(nonylphenyl)pentaerythritol diphosphite, tristearyl phosphite, distearyl pentaerythritol diphosphite, tris(2,4-di-t-butylphenyl) phosphite and a hydrogenated bisphenol A/pentaerythritol phosphite polymer.

Such other antiwear agents (B') may be used singly or may be used in combination of two or more kinds.

Such another antiwear agent (B') is preferably contained in an amount of 0.1 to 8 parts by mass based on 100 parts by mass of the lubricant component (A).

<Antioxidant (C)>

Examples of the antioxidant (C) for use in the present invention include phenol-based antioxidants and amine-based antioxidants. The lubricating oil composition for a timepiece according to the present invention hardly changes in quality for a long period because it contains the antioxidant (C).

Examples of the phenol-based antioxidants include 2,6-di-t-butyl-p-cresol, 2,4,6-tri-t-butylphenol and 4,4'-mehylenebis(2,6-di-t-butylphenol).

Examples of the amine-based antioxidants include a diphenylamine derivative, i.e., a compound in which a hydrogen atom of the benzene ring of diphenylamine is substituted by a straight-chain or branched alkyl group of 1 to 10 carbon atoms because change in quality of the lubricating oil composition is able to be further suppressed. Specific examples of such compounds preferably used include a diphenylamine derivative (C-1) represented by the following general formula (c-1).

(c-1)

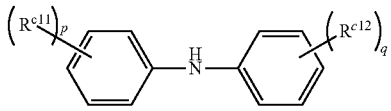

In the formula (c-1), $R^{c11}$ and $R^{c12}$ each independently represent a straight-chain or branched alkyl group of 1 to 10 carbon atoms.

Examples of the straight-chain or branched alkyl groups of 1 to 10 carbon atoms include methyl group, ethyl group, n-propyl group, n-butyl group, n-pentyl group, n-hexyl group, n-heptyl group, n-octyl group, n-nonyl group, n-decyl group, isopropyl group, sec-butyl group, isobutyl group, t-butyl group, isopentyl group, t-pentyl group, neopentyl group, isohexyl group, 2-ethylhexyl group, 2,4,4-trimethylpentyl group, and 1,1,3,3-tetramethylbutyl group.

p and q each independently represent an integer of 0 to 5, preferably an integer of 0 to 3. However, p and q do not represent 0 at the same time.

The diphenylamine derivative is obtained by a reaction of, for example, diphenylamine with a compound for introducing a straight-chain or branched alkyl group of 1 to 10 carbon atoms as a substituent (compound having a double bond, such as ethylene, propylene, 1-butene, 1-pentene, 1-hexene, 1-heptene, 1-octene, 1-nonene, 1-decene, 2-butene, 2-methylpropene, 3-methyl-1-butene, 2-methyl-1-butene, 4-methyl-1-pentene, 2-ethyl-1-hexene or 2,4,4-trimethylpentene).

Such antioxidants (C) for use in the present invention may be used singly or may be used in combination of two or more kinds.

In particular, as the amine-based antioxidants, one or two or more kinds of the diphenylamine derivatives (C-1) and one or two or more kinds of hindered amine compounds (C-2) represented by the following general formula (c-2) are preferably used in combination.

When the diphenylamine derivative (C-1) and the hindered amine compound (C-2) are combined, even in the case of using the lubricating oil composition in a sliding part to which great pressure is applied during sliding, formation of a deposit such as worn powder or rust is suppressed, color change of the sliding part hardly occurs, and durability can be improved. The reason is thought to be that an antioxidant generally has a function to make harmless an active species produced in the lubricating oil composition during sliding, and when the diphenylamine derivative (C-1) and the hindered amine compound (C-2) are combined, even an active species produced in a sliding part to which great pressure is applied during sliding can be made harmless over a long period of time.

(c-2)

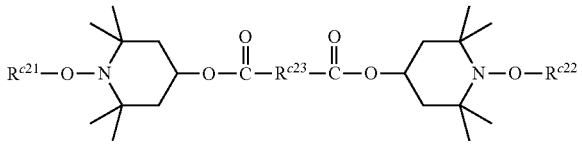

In the formula (c-2), $R^{c21}$ and $R^{c22}$ each independently represent an aliphatic hydrocarbon group of 1 to 10 carbon atoms.

The aliphatic hydrocarbon group of 1 to 10 carbon atoms may be a straight-chain, branched or cyclic aliphatic hydrocarbon group, and may be a saturated or unsaturated aliphatic hydrocarbon group.

Specific examples of the aliphatic hydrocarbon groups of 1 to 10 carbon atoms preferably used include straight-chain or branched alkyl groups, such as methyl group, ethyl group, n-propyl group, n-butyl group, n-pentyl group, n-hexyl group, heptyl group, octyl group, nonyl group, decyl group, isopropyl group, sec-butyl group, isobutyl group, t-butyl group, isopentyl group, t-pentyl group, neopentyl group, isohexyl group and 2-ethylhexyl group. Of these, straight-chain or branched alkyl groups of 5 to 10 carbon atoms are more preferable from the viewpoint of enhancement in durability.

$R^{c23}$ represents a divalent aliphatic hydrocarbon group of 1 to 10 carbon atoms.

Examples of the divalent aliphatic hydrocarbon groups of 1 to 10 carbon atoms preferably used include divalent straight-chain or branched alkylene groups, such as methylene group, 1,2-ethylene group, 1,3-propylene group, 1,4-butylene group, 1,5-pentylene group, 1,6-hexylene group, 1,7-heptylene group, 1,8-octylene group, 1,9-nonylene group, 1,10-decylene group and 3-methyl-1,5-pentylene group. Of these, divalent straight-chain or branched alkylene groups of 5 to 10 carbon atoms are more preferable from the viewpoint of enhancement in durability.

Particularly from the viewpoint of enhancement in durability at high temperatures, more preferable among the above groups are groups in which the total number of carbon atoms of $R^{c21}$, $R^{c22}$ and $R^{c23}$ is 16 to 30.

The antioxidant (C) is contained in an amount of 0.01 to 3 parts by mass based on 100 parts by mass of the lubricant component (A). When the diphenylamine derivative (C-1) and the hindered amine compound (C-2) are used in combination, it is preferable that they are each contained in an amount of 0.01 to 1.5 parts by mass based on 100 parts by mass of the lubricant component (A). They are preferably contained in the above proportions from the viewpoint of enhancement in durability.

<Viscosity Index Improver (D)>

The lubricating oil composition for a timepiece according to the present invention may further contain a viscosity index improver (D). When the lubricating oil composition contains the viscosity index improver (D), the composition can operate a timepiece more normally.

As the viscosity index improver (D), a hitherto publicly known one can be used, and examples thereof include polyacrylates, polymethacrylates, polyalkylstyrenes, polyesters, isobutylene fumarate, styrene maleate ester, vinyl acetate fumarate ester, α-olefin copolymers, a polybutadiene/styrene copolymer, a polymethyl methacrylate/vinylpyrrolidone copolymer, an ethylene/alkyl acrylate copolymer, polyisobutylene, lithium stearate, or derivatives of lithium stearate.

As the polyacrylates and the polymethacrylates, polymerization products of acrylic acid or methacrylic acid and polymers of $C_1$-$C_{10}$-alkyl esters thereof can be used. Of these, polymethacrylate obtained by polymerizing methyl methacrylate is preferable.

Specific examples of the polyalkylstyrenes include polymers of monoalkylstyrenes having substituents of 1 to 18 carbon atoms, such as poly-α-methylstyrene, poly-β-methylstyrene, poly-α-ethylstyrene and poly-β-ethylstyrene.

Examples of the polyesters include polyesters obtained from polyhydric alcohols of 1 to 10 carbon atoms, such as ethylene glycol, propylene glycol, neopentyl glycol and dipentaerythritol, and polybasic acids, such as oxalic acid, malonic acid, succinic acid, glutaric acid, adipic acid, fumaric acid and phthalic acid.

Specific examples of the α-olefin copolymers include an ethylene/propylene copolymer composed of constitutional repeating units derived from ethylene and constitutional repeating units derived from isopropylene, and reaction products similarly obtained by copolymerizing α-olefins of 2 to 18 carbon atoms, such as ethylene, propylene, butylene and butadiene.

The polyisobutylene preferably has a number-average molecular weight (Mn), as measured by GPC, of 3000 to 80000, and more preferably has Mn of 3000 to 50000 from the viewpoint of lubrication properties.

Specific examples of the derivatives of lithium stearate include lithium stearate in which a hydrogen atom is substituted by a hydroxy group, such as lithium 12-hydroxystearate.

The viscosity index improvers (D) may be used singly or may be used in combination of two or more kinds.

Of these, polyisobutylene, lithium stearate, or a derivative of lithium stearate is more preferably used because more favorable lubrication is enabled even if a timepiece is operated using them in a sliding part to which great pressure is applied during sliding. The reason is thought to be that inclusion of polyisobutylene, lithium stearate, or the derivative of lithium stearate causes an environment in which the antiwear agent (B) more easily functions.

The viscosity index improver (D) is preferably contained in an amount of 0.1 to 8 parts by mass based on 100 parts by mass of the lubricant component (A). From the viewpoint of enhancement in lubrication properties, the viscosity index improver is preferably contained in the above proportion.

<Metal Deactivator (E)>

The lubricating oil composition for a timepiece according to the present invention may further contain a metal deactivator (E). When the lubricating oil composition contains the metal deactivator (E), the composition can further suppress corrosion of a metal.

From the viewpoint of suppression of corrosion of a metal, the metal deactivator (E) is preferably benzotriazole or its derivative.

Specific examples of the benzotriazole derivatives include 2-(2'-hydroxy-5'-methylphenyl)benzotriazole, 2-[2'-hydroxy-3',5'-bis(α,α-dimethylbenzyl)phenyl]-benzotriazole, 2-(2'-hydroxy-3',5'-di-t-butyl-phenyl)-benzotriazole, and compounds having a structure represented by the following formula wherein R, R' and R" are each an alkyl group of 1 to 18 carbon atoms, such as 1-(N,N-bis(2-ethylhexyl)aminomethyl)benzotriazole.

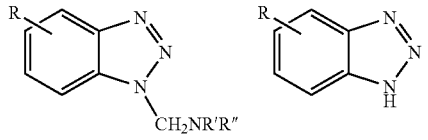

The metal deactivators (E) may be used singly or may be used in combination of two or more kinds.

The metal deactivator (E) is preferably contained in an amount of 0.01 to 3 parts by mass based on 100 parts by mass of the lubricant component (A). From the viewpoint of corrosion prevention, the metal deactivator is preferably contained in the above proportion.

[Timepiece]

In the timepiece according to the present invention, the aforesaid lubricating oil composition for a timepiece has been applied to sliding parts, such as a wheel train part and a mainspring encased in a barrel. The timepiece of the present invention is preferably a timepiece having a sliding part to which great pressure is applied during sliding. Examples of such sliding parts include sliding parts of a mechanical timepiece and sliding parts of an electronic timepiece designed so as to have, for example, many motors. Even if the timepiece of the present invention has a sliding part to which great pressure is applied, formation of a deposit such as worn powder or rust is suppressed during operating and color change of the sliding part hardly occurs because the aforesaid lubricating oil composition for a timepiece has been applied, and therefore, the timepiece of the present invention can stably work over a long period of time.

From the above, the present invention relates to the following.

[1] A lubricating oil composition for a timepiece, comprising a lubricant component (A) containing at least one base oil (A1) selected from a polyol ester (A-1), a paraffin-based hydrocarbon oil (A-2) having 25 or more carbon atoms and an ether oil (A-3), at least one antiwear agent (B) selected from a neutral phosphate ester (B-1) and a neutral phosphite ester (B-2), and an antioxidant (C), wherein the total acid number of the composition is not more than 0.8 mgKOH/g, the antiwear agent (B) is contained in an amount of 0.1 to 15 parts by mass based on 100 parts by mass of the lubricant component (A), and the antioxidant (C) is contained in an amount of 0.01 to 3 parts by mass based on 100 parts by mass of the lubricant component (A), and the neutral phosphate ester (B-1) is represented by the following general formula (b-1) and the neutral phosphite ester (B-2) is represented by the following general formula (b-2).

(b-1)

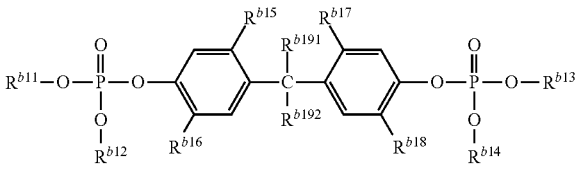

wherein $R^{b11}$ to $R^{b14}$ each independently represent an aliphatic hydrocarbon group of 10 to 16 carbon atoms, $R^{b15}$ to $R^{b18}$ each independently represent a straight-chain or branched alkyl group of 1 to 6 carbon atoms, $R^{b191}$ and $R^{b192}$ each independently represent a hydrogen atom or a straight-chain or branched alkyl group of 1 to 5 carbon atoms, and the total number of carbon atoms of $R^{b191}$ and $R^{b192}$ is 1 to 5, (b-2)

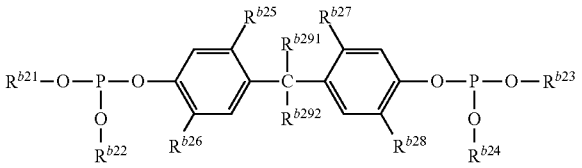

wherein $R^{b21}$ to $R^{b24}$ each independently represent an aliphatic hydrocarbon group of 10 to 16 carbon atoms, $R^{b25}$ to $R^{b28}$ each independently represent a straight-chain or branched alkyl group of 1 to 6 carbon atoms, $R^{b291}$ and $R^{b292}$ each independently represent a hydrogen atom or a straight-chain or branched alkyl group of 1 to 5 carbon atoms, and the total number of carbon atoms of $R^{b291}$ and $R^{b292}$ is 1 to 5.

Even when a timepiece is operated using the lubricating oil composition for a timepiece in a sliding part to which great pressure is applied, formation of a deposit such as worn powder or rust can be suppressed, and change in color of the sliding part hardly occurs. That is to say, according to the lubricating oil composition, even a mechanical timepiece or the like in which high pressure is applied to its sliding part can be favorably lubricated.

[2] The lubricating oil composition for a timepiece as stated in [1], wherein the polyol ester (A-1) is a polyol ester having no hydroxyl group at a molecular end.

[3] The lubricating oil composition for a timepiece as stated in [1] or [2], wherein the ether oil (A-3) is represented by the following general formula (a-3):

$$R^{a31}—(—O—R^{a33}—)_n—R^{a32} \quad \text{(a-3)}$$

wherein $R^{a31}$ and $R^{a32}$ are each independently an alkyl group of 1 to 18 carbon atoms or a monovalent aromatic hydrocarbon group of 6 to 18 carbon atoms, $R^{a33}$ is an alkylene group of 1 to 18 carbon atoms or a divalent aromatic hydrocarbon group of 6 to 18 carbon atoms, and n is an integer of 1 to 5.

[4] The lubricating oil composition for a timepiece as stated in any one of [1] to [3], wherein the antioxidant (C) is an amine-based antioxidant.

Change in quality of the lubricating oil composition can be further suppressed by using the amine-based antioxidant.

[5] The lubricating oil composition for a timepiece as stated in [4], wherein a diphenylamine derivative (C-1) represented by the following general formula (c-1) and a hindered amine compound (C-2) represented by the following general formula (c-2) are contained as the amine-based antioxidants.

(c-1)

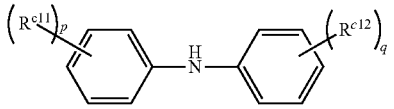

wherein $R^{c11}$ and $R^{c12}$ each independently represent a straight-chain or branched alkyl group of 1 to 10 carbon atoms, and p and q each independently represent an integer of 0 to 5 with the proviso that p and q do not represent 0 at the same time, (c-2)

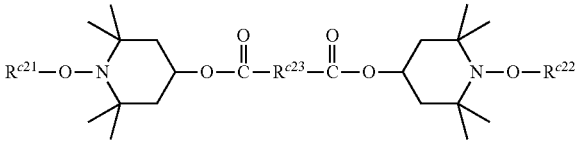

wherein $R^{c21}$ and $R^{c22}$ each independently represent an aliphatic hydrocarbon group of 1 to 10 carbon atoms, and $R^{c23}$ represents a divalent aliphatic hydrocarbon group of 1 to 10 carbon atoms.

When the diphenylamine derivative (C-1) and the hindered amine compound (C-2) are combined, even in the case of using the lubricating oil composition in a sliding part to which great pressure is applied during sliding, formation of a deposit such as worn powder or rust is suppressed, color change of the sliding part hardly occurs, and durability can be improved.

[6] The lubricating oil composition for a timepiece as stated in any one of [1] to [5], wherein not less than 30% by mass of the lubricant component (A) is the base oil (A1).

[7] The lubricating oil composition for a timepiece as stated in [6], wherein the lubricant component (A) consists of the base oil (A1).

[8] The lubricating oil composition for a timepiece as stated in [6], wherein the lubricant component (A) comprises the base oil (A1) and a solid lubricant (A2).

[9] The lubricating oil composition for a timepiece as stated in [8], wherein the content of the base oil (a1) is 30 to 70% by mass and the content of the solid lubricant (a2) is 70 to 30% by mass, based on 100% by mass of the lubricant component (A).

[10] The lubricating oil composition for a timepiece as stated in any one of [1] to [9], further comprising a viscosity index improver (D).

When the lubricating oil composition comprises the viscosity index improver (D), the composition can operate a timepiece more normally.

[11] The lubricating oil composition for a timepiece as stated in [10], wherein the viscosity index improver (D) is lithium stearate or a derivative of lithium stearate.

[12] The lubricating oil composition for a timepiece as stated in [10], wherein the viscosity index improver (D) is polyisobutylene.

When the lubricating oil composition comprises polyisobutylene, lithium stearate, or a derivative of lithium stearate, more favorable lubrication is enabled even if a timepiece is operated using it in a sliding part to which great pressure is applied during sliding.

[13] The lubricating oil composition for a timepiece as stated in any one of [1] to [12], further comprising a metal deactivator (E).

When the lubricating oil composition comprises the metal deactivator (E), it can further suppress corrosion of a metal.

[14] The lubricating oil composition for a timepiece as stated in [13], wherein the metal deactivator (E) is benzotriazole or a derivative thereof.

When benzotriazole or a derivative thereof is used, corrosion of a metal is further suppressed.

[15] A timepiece to sliding parts of which the lubricating oil composition for a timepiece as stated in any one of [1] to [14] has been applied.

Even when the timepiece has a sliding part to which great pressure is applied during sliding, formation of a deposit such as worn powder or rust is suppressed during operating and color change of the sliding part hardly occurs because the aforesaid lubricating oil composition for a timepiece has been applied, and therefore, the timepiece can stably work over a long period of time.

EXAMPLES

The present invention will be more specifically described hereinafter with reference to the following examples, but it should be construed that the present invention is in no way limited to those examples. In the following description, the term "part(s)" means "part(s) by mass" unless otherwise noted.

<Preparation 1 of Lubricating Oil Composition for Timepiece>

In the following specific examples, a base oil (A1) was used as the lubricant component (A).

Example 1-1-1

As the paraffin-based hydrocarbon oil (A-2) of the base oil (A1), a trimer of 1-decene was used, and to 100 parts of this base oil were added 5 parts of 4,4'-butylidenebis(3-methyl-6-t-butylphenyl ditridecyl phosphate) as a neutral phosphate ester (B-1) of the antiwear agent (B) and 0.5 part of a diphenylamine derivative (reaction product of diphenylamine with 2,4,4-trimethylpentene (reaction product: IRGANOX L57 (trade name), available from Ciba Specialty Chemicals Inc.)) as the antioxidant (C), to prepare a lubricating oil composition for a timepiece.

The kinematic viscosity of the above base oil at −30° C. was less than 2000 cSt, and the number of carbon atoms thereof was 30.

Example 1-1-2

A lubricating oil composition for a timepiece was prepared in the same manner as in Example 1-1-1, except that the amount of the neutral phosphate ester (B-1) was changed to 0.1 part.

Example 1-1-3

A lubricating oil composition for a timepiece was prepared in the same manner as in Example 1-1-1, except that the amount of the neutral phosphate ester (B-1) was changed to 8 parts.

Example 1-1-4

A lubricating oil composition for a timepiece was prepared in the same manner as in Example 1-1-1, except that the amount of the antioxidant (C) was changed to 0.01 part.

Example 1-1-5

A lubricating oil composition for a timepiece was prepared in the same manner as in Example 1-1-1, except that the amount of the antioxidant (C) was changed to 3 parts.

Examples 1-2-1 to 1-2-6

Lubricating oil compositions for timepieces were prepared in the same manner as in Example 1-1-1, except that the compounds of Table 1 were each used as the neutral phosphate ester (B-1) instead of 4,4'-butylidenebis(3-methyl-6-t-butylphenyl ditridecyl phosphate) ($R^{b11}$ to $R^{b14}$=tridecyl group, $R^{b15}$, $R^{b17}$ methyl group, $R^{b16}$, $R^{b18}$=t-butyl group, $R^{b191}$=hydrogen atom, $R^{b192}$=n-propyl group).

TABLE 1

Neutral phosphate esters (B-1) used in Examples 1-2-1 to 1-2-6

| Example | $R^{b11}$-$R^{b14}$ | $R^{b15}$, $R^{b17}$ | $R^{b16}$, $R^{b18}$ | $R^{b191}$ | $R^{b192}$ |
|---|---|---|---|---|---|
| 1-2-1 | decyl group | methyl group | t-butyl group | hydrogen atom | n-propyl group |
| 1-2-2 | hexadecyl group | methyl group | t-butyl group | hydrogen atom | n-propyl group |
| 1-2-3 | tridecyl group | n-propyl group | t-butyl group | hydrogen atom | n-propyl group |
| 1-2-4 | tridecyl group | methyl group | isopropyl group | hydrogen atom | n-propyl group |
| 1-2-5 | tridecyl group | methyl group | t-butyl group | hydrogen atom | n-pentyl group |
| 1-2-6 | tridecyl group | methyl group | t-butyl group | ethyl group | n-propyl group |

Example 1-3-1

A lubricating oil composition for a timepiece was prepared in the same manner as in Example 1-1-1, except that 0.5 part of a diphenylamine derivative (IRGANOX L57 (trade name), available from Ciba Specialty Chemicals Inc.) and 0.5 part of bis(2,2,6,6-tetramethyl-1-(octyloxy)piperidin-4-yl) decanedioate were used as the antioxidant (C) instead of 0.5 part of the diphenylamine derivative (IRGANOX L57 (trade name), available from Ciba Specialty Chemicals Inc.).

Example 1-3-2

A lubricating oil composition for a timepiece was prepared in the same manner as in Example 1-3-1, except that each of the amounts of the diphenylamine derivative (IRGANOX L57 (trade name), available from Ciba Specialty Chemicals Inc.) and bis(2,2,6,6-tetramethyl-1-(octyloxy)piperidin-4-yl) decanedioate was changed to 0.01 part.

Example 1-3-3

A lubricating oil composition for a timepiece was prepared in the same manner as in Example 1-3-1, except that each of the amounts of the diphenylamine derivative (IRGANOX L57 (trade name), available from Ciba Specialty Chemicals Inc.) and bis(2,2,6,6-tetramethyl-1-(octyloxy)piperidin-4-yl) decanedioate was changed to 1.5 parts.

Examples 1-4-1 to 1-4-6

Lubricating oil compositions for timepieces were prepared in the same manner as in Example 1-3-1, except that the compounds of Table 2 were each used instead of bis(2,2,6,6-tetramethyl-1-(octyloxy)piperidin-4-yl) decanedioate ($R^{c21}$, $R^{c22}$=n-octyl group, $R^{c23}$=1,8-octylene group).

TABLE 2

Hindered amine compounds (C-2) used in Examples 1-4-1 to 1-4-6

| Example | $R^{c21}$ | $R^{c22}$ | $R^{c23}$ |
|---|---|---|---|
| 1-4-1 | methyl group | methyl group | methylene group |
| 1-4-2 | n-propyl group | n-propyl group | 1,3-propylene group |
| 1-4-3 | n-pentyl group | n-pentyl group | 1,5-pentylene group |
| 1-4-4 | n-pentyl group | n-pentyl group | 1,6-hexylene group |
| 1-4-5 | n-hexyl group | n-hexyl group | 1,6-hexylene group |
| 1-4-6 | n-decyl group | n-decyl group | 1,10-decylene group |

Examples 1-5-1 to 1-5-4

Lubricating oil compositions for timepieces were prepared in the same manner as in Example 1-3-1, except that the compounds of Table 3 were each used instead of a diphenylamine derivative (IRGANOX L57 (trade name), available from Ciba Specialty Chemicals Inc.).

TABLE 3

Diphenylamine derivatives (C-1) used in Examples 1-5-1 to 1-5-4

| Example | $R^{c11}$ | $R^{c12}$ | p | q |
|---|---|---|---|---|
| 1-5-1 | ethyl group | ethyl group | 1 | 1 |
| 1-5-2 | n-hexyl group | n-hexyl group | 1 | 1 |
| 1-5-3 | n-decyl group | n-decyl group | 1 | 1 |
| 1-5-4 | t-butyl group | t-butyl group | 1 | 1 |

Example 1-6-1

A lubricating oil composition for a timepiece was prepared in the same manner as in Example 1-1-1, except that 4,4'-butylidenebis(3-methyl-6-t-butylphenyl ditridecyl phosphite) was used as the neutral phosphite ester (B-2)

instead of 4,4'-butylidenebis(3-methyl-6-t-butylphenyl ditridecyl phosphate) as the neutral phosphate ester (B-1) of the antiwear agent (B).

Example 1-6-2

A lubricating oil composition for a timepiece was prepared in the same manner as in Example 1-6-1, except that the amount of the neutral phosphite ester (B-2) was changed to 0.1 part.

Example 1-6-3

A lubricating oil composition for a timepiece was prepared in the same manner as in Example 1-6-1, except that the amount of the neutral phosphite ester (B-2) was changed to 8 parts.

Example 1-6-4

A lubricating oil composition for a timepiece was prepared in the same manner as in Example 1-6-1, except that the amount of the antioxidant (C) was changed to 0.01 part.

Example 1-6-5

A lubricating oil composition for a timepiece was prepared in the same manner as in Example 1-6-1, except that the amount of the antioxidant (C) was changed to 3 parts.

Examples 1-7-1 to 1-7-6

Lubricating oil compositions for timepieces were prepared in the same manner as in Example 1-6-1, except that the compounds of Table 4 were each used as the neutral phosphite ester (B-2) instead of 4,4'-butylidenebis(3-methyl-6-t-butylphenyl ditridecyl phosphate) ($R^{b21}$ to $R^{b24}$=tridecyl group, $R^{b25}$, $R^{b27}$=methyl group, $R^{b26}$, $R^{b28}$=t-butyl group, $R^{b291}$=hydrogen atom, $R^{b292}$=n-propyl group).

TABLE 4

Neutral phosphite esters (B-2) used in Examples 1-7-1 to 1-7-6

| Example | $R^{b21}$-$R^{b24}$ | $R^{b25}$, $R^{27}$ | $R^{b26}$, $R^{b28}$ | $R^{b291}$ | $R^{b292}$ |
|---|---|---|---|---|---|
| 1-7-1 | decyl group | methyl group | t-butyl group | hydrogen atom | n-propyl group |
| 1-7-2 | hexadecyl group | methyl group | t-butyl group | hydrogen atom | n-propyl group |
| 1-7-3 | tridecyl group | n-propyl group | t-butyl group | hydrogen atom | n-propyl group |
| 1-7-4 | tridecyl group | methyl group | isopropyl group | hydrogen atom | n-propyl group |
| 1-7-5 | tridecyl group | methyl group | t-butyl group | hydrogen atom | n-pentyl group |
| 1-7-6 | tridecyl group | methyl group | t-butyl group | ethyl group | n-propyl group |

Example 1-8-1

A lubricating oil composition for a timepiece was prepared in the same manner as in Example 1-6-1, except that 0.5 part of a diphenylamine derivative (IRGANOX L57 (trade name), available from Ciba Specialty Chemicals Inc.) and 0.5 part of bis(2,2,6,6-tetramethyl-1-(octyloxy)piperidin-4-yl) decanedioate were used as the antioxidant (C) instead of 0.5 part of the diphenylamine derivative (IRGANOX L57 (trade name), available from Ciba Specialty Chemicals Inc.).

Example 1-8-2

A lubricating oil composition for a timepiece was prepared in the same manner as in Example 1-8-1, except that each of the amounts of the diphenylamine derivative (IRGANOX L57 (trade name), available from Ciba Specialty Chemicals Inc.) and bis(2,2,6,6-tetramethyl-1-(octyloxy)piperidin-4-yl) decanedioate was changed to 0.01 part.

Example 1-8-3

A lubricating oil composition for a timepiece was prepared in the same manner as in Example 1-8-1, except that each of the amounts of the diphenylamine derivative (IRGANOX L57 (trade name), available from Ciba Specialty Chemicals Inc.) and bis(2,2,6,6-tetramethyl-1-(octyloxy)piperidin-4-yl) decanedioate was changed to 1.5 parts.

Examples 1-9-1 to 1-9-6

Lubricating oil compositions for timepieces were prepared in the same manner as in Example 1-8-1, except that the compounds of Table 5 were each used instead of bis(2,2,6,6-tetramethyl-1-(octyloxy)piperidin-4-yl) decanedioate ($R^{c21}$, $R^{c22}$=n-octyl group, $R^{c23}$=1,8-octylene group).

TABLE 5

Hindered amine compounds (C-2) used in Examples 1-9-1 to 1-9-6

| Example | $R^{c21}$ | $R^{c22}$ | $R^{c23}$ |
|---|---|---|---|
| 1-9-1 | methyl group | methyl group | methylene group |
| 1-9-2 | n-propyl group | n-propyl group | 1,3-propylene group |
| 1-9-3 | n-pentyl group | n-pentyl group | 1,5-pentylene group |
| 1-9-4 | n-pentyl group | n-pentyl group | 1,6-hexylene group |
| 1-9-5 | n-hexyl group | n-hexyl group | 1,6-hexylene group |
| 1-9-6 | n-decyl group | n-decyl group | 1,10-decylene group |

Examples 1-10-1 to 1-10-4

Lubricating oil compositions for timepieces were prepared in the same manner as in Example 1-8-1, except that the compounds of Table 6 were each used instead of a diphenylamine derivative (IRGANOX L57 (trade name), available from Ciba Specialty Chemicals Inc.).

TABLE 6

Diphenylamine derivatives (C-1) used in Examples 1-10-1 to 1-10-4

| Example | $R^{c11}$ | $R^{c12}$ | p | q |
|---|---|---|---|---|
| 1-10-1 | ethyl group | ethyl group | 1 | 1 |
| 1-10-2 | n-hexyl group | n-hexyl group | 1 | 1 |
| 1-10-3 | n-decyl group | n-decyl group | 1 | 1 |
| 1-10-4 | t-butyl group | t-butyl group | 1 | 1 |

Example 1-11

A lubricating oil composition for a timepiece was prepared by further using the viscosity index improver (D) in the lubricating oil composition for a timepiece of Example 1-1-1.

Specifically, first, 12-hydroxystearic acid and a trimer of 1-decene were put in a container, and heated. In the container, an aqueous LiOH solution was put, the resultant was dehydrated while being continuously warmed to be allowed to react, and was further warmed, and a trimer of 1-decene was input. A trimer of 1-decene was added to adjust a consistency to 200 with a three-roll mill, and a mixture of a derivative of lithium stearate with a trimer of 1-decene was obtained.

Then, 4,4'-butylidenebis(3-methyl-6-t-butylphenyl ditridecyl phosphate) as the neutral phosphate ester (B-1) and a diphenylamine derivative (IRGANOX L57 (trade name), available from Ciba Specialty Chemicals Inc.) as the antioxidant (C) were added to the mixture, to prepare a lubricating oil composition for a timepiece. Each component was adjusted and added so that the lubricating oil composition contains 5 parts of the neutral phosphate ester (B-1), 0.5 part of the antioxidant (C), and 5 parts of the above lithium 12-hydroxystearate as the viscosity index improver (D), based on 100 parts of the paraffin-based hydrocarbon oil (A-2).

The kinematic viscosity of the above base oil at −30° C. was less than 2000 cSt, and the number of carbon atoms thereof was 30.

Example 1-12

A lubricating oil composition for a timepiece was prepared by further using the viscosity index improver (D) in the lubricating oil composition for a timepiece of Example 1-1-1.

Specifically, as the paraffin-based hydrocarbon oil (A-2) of the base oil (A1), a trimer of 1-decene was used, and to 100 parts of the base oil were added 5 parts of 4,4'-butylidenebis(3-methyl-6-t-butylphenyl ditridecyl phosphate) as the neutral phosphate ester (B-1) of the antiwear agent (B), 0.5 part of a diphenylamine derivative (IRGANOX L57 (trade name), available from Ciba Specialty Chemicals Inc.) as the antioxidant (C), and 5 parts of polyisobutylene as the viscosity index improver (D), to prepare a lubricating oil composition for a timepiece.

The kinematic viscosity of the above base oil at −30° C. was less than 2000 cSt, and the number of carbon atoms thereof was 30. The number-average molecular weight of polyisobutylene, as measured by GPC, was 3700.

Example 1-13

A lubricating oil composition for a timepiece was prepared by further using the viscosity index improver (D) in the lubricating oil composition for a timepiece of Example 1-6-1.

Specifically, first, 12-hydroxystearic acid and a trimer of 1-decene were put in a container, and heated. In the container, an aqueous LiOH solution was put, the resultant was dehydrated while being continuously warmed to be allowed to react, and was further warmed, and a trimer of 1-decene was input. A trimer of 1-decene was added to adjust a consistency to 200 with a three-roll mill, and a mixture of a derivative of lithium stearate with a trimer of 1-decene was obtained.

Then, 4,4'-butylidenebis(3-methyl-6-t-butylphenyl ditridecyl phosphite) as the neutral phosphite ester (B-2) and a diphenylamine derivative (IRGANOX L57 (trade name), available from Ciba Specialty Chemicals Inc.) as the antioxidant (C) were added to the mixture, to prepare a lubricating oil composition for a timepiece. Each component was adjusted and added so that the lubricating oil composition contains 5 parts of the neutral phosphite ester (B-2), 0.5 part of the antioxidant (C), and 5 parts of the above lithium 12-hydroxystearate as the viscosity index improver (D), based on 100 parts of the paraffin-based hydrocarbon oil (A-2).

The kinematic viscosity of the above base oil at −30° C. was less than 2000 cSt, and the number of carbon atoms thereof was 30.

Example 1-14

A lubricating oil composition for a timepiece was prepared by further using the viscosity index improver (D) in the lubricating oil composition for a timepiece of Example 1-6-1.

Specifically, as the paraffin-based hydrocarbon oil (A-2) of the base oil (A1), a trimer of 1-decene was used, and to 100 parts of the base oil were added 5 parts of 4,4'-butylidenebis(3-methyl-6-t-butylphenyl ditridecyl phosphite) as the neutral phosphite ester (B-2) of the antiwear agent (B), 0.5 part of a diphenylamine derivative (IRGANOX L57 (trade name), available from Ciba Specialty Chemicals Inc.) as the antioxidant (C), and 5 parts of polyisobutylene as the viscosity index improver (D), to prepare a lubricating oil composition for a timepiece.

The kinematic viscosity of the above base oil at −30° C. was less than 2000 cSt, and the number of carbon atoms thereof was 30. The number-average molecular weight of polyisobutylene, as measured by GPC, was 3700.

Example 1-15

A lubricating oil composition for a timepiece was prepared by further using the metal deactivator (E) in the lubricating oil composition for a timepiece of Example 1-1-1.

Specifically, as the paraffin-based hydrocarbon oil (A-2) of the base oil (A1), a trimer of 1-decene was used, and to 100 parts of the base oil were added 5 parts of 4,4'-butylidenebis(3-methyl-6-t-butylphenyl ditridecyl phosphate) as the neutral phosphate ester (B-1) of the antiwear agent (B), 0.5 part of a diphenylamine derivative (IRGANOX L57 (trade name), available from Ciba Specialty Chemicals Inc.) as the antioxidant (C), and 0.05 part of benzotriazole as the metal deactivator (E), to prepare a lubricating oil composition for a timepiece.

The kinematic viscosity of the above base oil at −30° C. was less than 2000 cSt, and the number of carbon atoms thereof was 30.

Example 1-16

A lubricating oil composition for a timepiece was prepared by further using the metal deactivator (E) in the lubricating oil composition for a timepiece of Example 1-6-1.

Specifically, as the paraffin-based hydrocarbon oil (A-2) of the base oil (A1), a trimer of 1-decene was used, and to 100 parts of the base oil were added 5 parts of 4,4'-butylidenebis(3-methyl-6-t-butylphenyl ditridecyl phosphite) as the neutral phosphite ester (B-2) of the antiwear agent (B), 0.5 part of a diphenylamine derivative (IRGANOX L57 (trade name), available from Ciba Specialty Chemicals Inc.) as the antioxidant (C), and 0.05 part of benzotriazole as the metal deactivator (E), to prepare a lubricating oil composition for a timepiece.

The kinematic viscosity of the above base oil at −30° C. was less than 2000 cSt, and the number of carbon atoms thereof was 30.

Examples 2-1-1 to 2-1-5

Lubricating oil compositions for timepieces were prepared in the same manner as in Examples 1-1-1 to 1-1-5, respectively, except that a neopentyl glycol/caprylic acid capric acid mixed ester (kinematic viscosity at −30° C.=less than 2000 cSt) was used as the polyol ester (A-1) instead of a trimer of 1-decene that was the paraffin-based hydrocarbon oil (A-2) of the base oil (A1).

Examples 2-2-1 to 2-2-6

Lubricating oil compositions for timepieces were prepared in the same manner as in Examples 1-2-1 to 1-2-6, respectively, except that a neopentyl glycol/caprylic acid capric acid mixed ester (kinematic viscosity at −30° C.=less than 2000 cSt) was used as the polyol ester (A-1) instead of a trimer of 1-decene that was the paraffin-based hydrocarbon oil (A-2) of the base oil (A1).

Examples 2-3-1 to 2-3-3

Lubricating oil compositions for timepieces were prepared in the same manner as in Examples 1-3-1 to 1-3-3, respectively, except that a neopentyl glycol/caprylic acid capric acid mixed ester (kinematic viscosity at −30° C.=less than 2000 cSt) was used as the polyol ester (A-1) instead of a trimer of 1-decene that was the paraffin-based hydrocarbon oil (A-2) of the base oil (A1).

Examples 2-4-1 to 2-4-6

Lubricating oil compositions for timepieces were prepared in the same manner as in Examples 1-4-1 to 1-4-6, respectively, except that a neopentyl glycol/caprylic acid capric acid mixed ester (kinematic viscosity at −30° C.=less than 2000 cSt) was used as the polyol ester (A-1) instead of a trimer of 1-decene that was the paraffin-based hydrocarbon oil (A-2) of the base oil (A1).

Examples 2-5-1 to 2-5-4

Lubricating oil compositions for timepieces were prepared in the same manner as in Examples 1-5-1 to 1-5-4, respectively, except that a neopentyl glycol/caprylic acid capric acid mixed ester (kinematic viscosity at −30° C.=less than 2000 cSt) was used as the polyol ester (A-1) instead of a trimer of 1-decene that was the paraffin-based hydrocarbon oil (A-2) of the base oil (A1).

Examples 2-6-1 to 2-6-5

Lubricating oil compositions for timepieces were prepared in the same manner as in Examples 1-6-1 to 1-6-5, respectively, except that a neopentyl glycol/caprylic acid capric acid mixed ester (kinematic viscosity at −30° C.=less than 2000 cSt) was used as the polyol ester (A-1) instead of a trimer of 1-decene that was the paraffin-based hydrocarbon oil (A-2) of the base oil (A1).

Examples 2-7-1 to 2-7-6

Lubricating oil compositions for timepieces were prepared in the same manner as in Examples 1-7-1 to 1-7-6, respectively, except that a neopentyl glycol/caprylic acid capric acid mixed ester (kinematic viscosity at −30° C.=less than 2000 cSt) was used as the polyol ester (A-1) instead of a trimer of 1-decene that was the paraffin-based hydrocarbon oil (A-2) of the base oil (A1).

Examples 2-8-1 to 2-8-3

Lubricating oil compositions for timepieces were prepared in the same manner as in Examples 1-8-1 to 1-8-3, respectively, except that a neopentyl glycol/caprylic acid capric acid mixed ester (kinematic viscosity at −30° C.=less than 2000 cSt) was used as the polyol ester (A-1) instead of a trimer of 1-decene that was the paraffin-based hydrocarbon oil (A-2) of the base oil (A1).

Examples 2-9-1 to 2-9-6

Lubricating oil compositions for timepieces were prepared in the same manner as in Examples 1-9-1 to 1-9-6, respectively, except that a neopentyl glycol/caprylic acid capric acid mixed ester (kinematic viscosity at −30° C.=less than 2000 cSt) was used as the polyol ester (A-1) instead of a trimer of 1-decene that was the paraffin-based hydrocarbon oil (A-2) of the base oil (A1).

Examples 2-10-1 to 2-10-4

Lubricating oil compositions for timepieces were prepared in the same manner as in Examples 1-10-1 to 1-10-4, respectively, except that a neopentyl glycol/caprylic acid capric acid mixed ester (kinematic viscosity at −30° C.=less than 2000 cSt) was used as the polyol ester (A-1) instead of a trimer of 1-decene that was the paraffin-based hydrocarbon oil (A-2) of the base oil (A1).

Example 2-11

A lubricating oil composition for a timepiece was prepared by further using the viscosity index improver (D) in the lubricating oil composition for a timepiece of Example 2-1-1.

Specifically, first, 12-hydroxystearic acid and a neopentyl glycol/caprylic acid capric acid mixed ester (kinematic viscosity at −30° C.=less than 2000 cSt) were put in a container, and heated. In the container, an aqueous LiOH solution was put, the resultant was dehydrated while being continuously warmed to be allowed to react, and was further warmed, and a neopentyl glycol/caprylic acid capric acid mixed ester was input. A neopentyl glycol/caprylic acid capric acid mixed ester was added to adjust a consistency to 200 with a three-roll mill, and a mixture of a derivative of lithium stearate with a neopentyl glycol/caprylic acid capric acid mixed ester was obtained.

Then, 4,4'-butylidenebis(3-methyl-6-t-butylphenyl ditridecyl phosphate) as the neutral phosphate ester (B-1) and a diphenylamine derivative (IRGANOX L57 (trade name), available from Ciba Specialty Chemicals Inc.) as the antioxidant (C) were added to the mixture, to prepare a lubricating oil composition for a timepiece. Each component was adjusted and added so that the lubricating oil composition contains 5 parts of the neutral phosphate ester (B-1), 0.5 part of the antioxidant (C), and 5 parts of the above lithium 12-hydroxystearate as the viscosity index improver (D), based on 100 parts of the polyol ester (A-1).

Example 2-12

A lubricating oil composition for a timepiece was prepared by further using the viscosity index improver (D) in the lubricating oil composition for a timepiece of Example 2-1-1.

Specifically, as the polyol ester (A-1) of the base oil (A1), a neopentyl glycol/caprylic acid capric acid mixed ester (kinematic viscosity at −30° C.=less than 2000 cSt) was used, and to 100 parts of the base oil were added 5 parts of 4,4'-butylidenebis(3-methyl-6-t-butylphenyl ditridecyl phosphate) as the neutral phosphate ester (B-1) of the antiwear agent (B), 0.5 part of a diphenylamine derivative (IRGANOX L57 (trade name), available from Ciba Specialty Chemicals Inc.) as the antioxidant (C), and 5 parts of polyisobutylene as the viscosity index improver (D), to prepare a lubricating oil composition for a timepiece.

The number-average molecular weight of polyisobutylene, as measured by GPC, was 3700.

Example 2-13

A lubricating oil composition for a timepiece was prepared by further using the viscosity index improver (D) in the lubricating oil composition for a timepiece of Example 2-6-1.

Specifically, first, 12-hydroxystearic acid and a neopentyl glycol/caprylic acid capric acid mixed ester (kinematic viscosity at −30° C.=less than 2000 cSt) were put in a container, and heated. In the container, an aqueous LiOH solution was put, the resultant was dehydrated while being continuously warmed to be allowed to react, and was further warmed, and a neopentyl glycol/caprylic acid capric acid mixed ester was input. A neopentyl glycol/caprylic acid capric acid mixed ester was added to adjust a consistency to 200 with a three-roll mill, and a mixture of a derivative of lithium stearate with a neopentyl glycol/caprylic acid capric acid mixed ester was obtained.

Then, 4,4'-butylidenebis(3-methyl-6-t-butylphenyl ditridecyl phosphite) as the neutral phosphite ester (B-2) and a diphenylamine derivative (IRGANOX L57 (trade name), available from Ciba Specialty Chemicals Inc.) as the antioxidant (C) were added to the mixture, to prepare a lubricating oil composition for a timepiece. Each component was adjusted and added so that the lubricating oil composition contains 5 parts of the neutral phosphite ester (B-2), 0.5 part of the antioxidant (C), and 5 parts of the above lithium 12-hydroxystearate as the viscosity index improver (D), based on 100 parts of the polyol ester (A-1).

Example 2-14

A lubricating oil composition for a timepiece was prepared by further using the viscosity index improver (D) in the lubricating oil composition for a timepiece of Example 2-6-1.

Specifically, as the polyol ester (A-1) of the base oil (A1), a neopentyl glycol/caprylic acid capric acid mixed ester (kinematic viscosity at −30° C.=less than 2000 cSt) was used, and to 100 parts of the base oil were added 5 parts of 4,4'-butylidenebis(3-methyl-6-t-butylphenyl ditridecyl phosphite) as the neutral phosphite ester (B-2) of the antiwear agent (B), 0.5 part of a diphenylamine derivative (IRGANOX L57 (trade name), available from Ciba Specialty Chemicals Inc.) as the antioxidant (C), and 5 parts of polyisobutylene as the viscosity index improver (D), to prepare a lubricating oil composition for a timepiece.

The number-average molecular weight of polyisobutylene, as measured by GPC, was 3700.

Example 2-15

A lubricating oil composition for a timepiece was prepared by further using the metal deactivator (E) in the lubricating oil composition for a timepiece of Example 2-1-1.

Specifically, as the polyol ester (A-1) of the base oil (A1), a neopentyl glycol/caprylic acid capric acid mixed ester (kinematic viscosity at −30° C.=less than 2000 cSt) was used, and to 100 parts of the base oil were added 5 parts of 4,4'-butylidenebis(3-methyl-6-t-butylphenyl ditridecyl phosphate) as the neutral phosphate ester (B-1) of the antiwear agent (B), 0.5 part of a diphenylamine derivative (IRGANOX L57 (trade name), available from Ciba Specialty Chemicals Inc.) as the antioxidant (C), and 0.05 part of benzotriazole as the metal deactivator (E), to prepare a lubricating oil composition for a timepiece.

Example 2-16

A lubricating oil composition for a timepiece was prepared by further using the metal deactivator (E) in the lubricating oil composition for a timepiece of Example 2-6-1.

Specifically, as the polyol ester (A-1) of the base oil (A1), a neopentyl glycol/caprylic acid capric acid mixed ester (kinematic viscosity at −30° C.=less than 2000 cSt) was used, and to 100 parts of the base oil were added 5 parts of 4,4'-butylidenebis(3-methyl-6-t-butylphenyl ditridecyl phosphite) as the neutral phosphite ester (B-2) of the antiwear agent (B), 0.5 part of a diphenylamine derivative (IRGANOX L57 (trade name), available from Ciba Specialty Chemicals Inc.) as the antioxidant (C), and 0.05 part of benzotriazole as the metal deactivator (E), to prepare a lubricating oil composition for a timepiece.

Examples 3-1-1 to 3-1-5

Lubricating oil compositions for timepieces were prepared in the same manner as in Examples 1-1-1 to 1-1-5, respectively, except that an alkyl-substituted diphenyl ether (trade name: MORESCO-HILUBE LB32, available from MATSUMURA OIL Co., Ltd.) was used as the ether oil (A-3) instead of a trimer of 1-decene that was the paraffin-based hydrocarbon oil (A-2) of the base oil (A1).

Examples 3-2-1 to 3-2-6

Lubricating oil compositions for timepieces were prepared in the same manner as in Examples 1-2-1 to 1-2-6, respectively, except that an alkyl-substituted diphenyl ether (trade name: MORESCO-HILUBE LB32, available from MATSUMURA OIL Co., Ltd.) was used as the ether oil (A-3) instead of a trimer of 1-decene that was the paraffin-based hydrocarbon oil (A-2) of the base oil (A1).

Examples 3-3-1 to 3-3-3

Lubricating oil compositions for timepieces were prepared in the same manner as in Examples 1-3-1 to 1-3-3, respectively, except that an alkyl-substituted diphenyl ether (trade name: MORESCO-HILUBE LB32, available from MATSUMURA OIL Co., Ltd.) was used as the ether oil (A-3) instead of a trimer of 1-decene that was the paraffin-based hydrocarbon oil (A-2) of the base oil (A1).

Examples 3-4-1 to 3-4-6

Lubricating oil compositions for timepieces were prepared in the same manner as in Examples 1-4-1 to 1-4-6, respectively, except that an alkyl-substituted diphenyl ether (trade name: MORESCO-HILUBE LB32, available from MATSUMURA OIL Co., Ltd.) was used as the ether oil (A-3) instead of a trimer of 1-decene that was the paraffin-based hydrocarbon oil (A-2) of the base oil (A1).

Examples 3-5-1 to 3-5-4

Lubricating oil compositions for timepieces were prepared in the same manner as in Examples 1-5-1 to 1-5-4, respectively, except that an alkyl-substituted diphenyl ether (trade name: MORESCO-HILUBE LB32, available from MATSUMURA OIL Co., Ltd.) was used as the ether oil (A-3) instead of a trimer of 1-decene that was the paraffin-based hydrocarbon oil (A-2) of the base oil (A1).

Examples 3-6-1 to 3-6-5

Lubricating oil compositions for timepieces were prepared in the same manner as in Examples 1-6-1 to 1-6-5, respectively, except that an alkyl-substituted diphenyl ether (trade name: MORESCO-HILUBE LB32, available from MATSUMURA OIL Co., Ltd.) was used as the ether oil (A-3) instead of a trimer of 1-decene that was the paraffin-based hydrocarbon oil (A-2) of the base oil (A1).

Examples 3-7-1 to 3-7-6

Lubricating oil compositions for timepieces were prepared in the same manner as in Examples 1-7-1 to 1-7-6, respectively, except that an alkyl-substituted diphenyl ether (trade name: MORESCO-HILUBE LB32, available from MATSUMURA OIL Co., Ltd.) was used as the ether oil (A-3) instead of a trimer of 1-decene that was the paraffin-based hydrocarbon oil (A-2) of the base oil (A1).

Examples 3-8-1 to 3-8-3

Lubricating oil compositions for timepieces were prepared in the same manner as in Examples 1-8-1 to 1-8-3, respectively, except that an alkyl-substituted diphenyl ether (trade name: MORESCO-HILUBE LB32, available from MATSUMURA OIL Co., Ltd.) was used as the ether oil (A-3) instead of a trimer of 1-decene that was the paraffin-based hydrocarbon oil (A-2) of the base oil (A1).

Examples 3-9-1 to 3-9-6

Lubricating oil compositions for timepieces were prepared in the same manner as in Examples 1-9-1 to 1-9-6, respectively, except that an alkyl-substituted diphenyl ether (trade name: MORESCO-HILUBE LB32, available from MATSUMURA OIL Co., Ltd.) was used as the ether oil (A-3) instead of a trimer of 1-decene that was the paraffin-based hydrocarbon oil (A-2) of the base oil (A1).

Examples 3-10-1 to 3-10-4

Lubricating oil compositions for timepieces were prepared in the same manner as in Examples 1-10-1 to 1-10-4, respectively, except that an alkyl-substituted diphenyl ether (trade name: MORESCO-HILUBE LB32, available from MATSUMURA OIL Co., Ltd.) was used as the ether oil (A-3) instead of a trimer of 1-decene that was the paraffin-based hydrocarbon oil (A-2) of the base oil (A1).

Example 3-11

A lubricating oil composition for a timepiece was prepared by further using the viscosity index improver (D) in the lubricating oil composition for a timepiece of Example 3-1-1.

Specifically, first, 12-hydroxystearic acid and an alkyl-substituted diphenyl ether (trade name: MORESCO-HILUBE LB32, available from MATSUMURA OIL Co., Ltd.) were put in a container, and heated. In the container, an aqueous LiOH solution was put, the resultant was dehydrated while being continuously warmed to be allowed to react, and was further warmed, and an alkyl-substituted diphenyl ether was input. An alkyl-substituted diphenyl ether was added to adjust a consistency to 200 with a three-roll mill, and a mixture of a derivative of lithium stearate with an alkyl-substituted diphenyl ether was obtained.

Then, 4,4'-butylidenebis(3-methyl-6-t-butylphenyl ditridecyl phosphate) as the neutral phosphate ester (B-1) and a diphenylamine derivative (IRGANOX L57 (trade name), available from Ciba Specialty Chemicals Inc.) as the antioxidant (C) were added to the mixture, to prepare a lubricating oil composition for a timepiece. Each component was adjusted and added so that the lubricating oil composition contains 5 parts of the neutral phosphate ester (B-1), 0.5 part of the antioxidant (C), and 5 parts of the above lithium 12-hydroxystearate as the viscosity index improver (D), based on 100 parts of the ether oil (A-3).

Example 3-12

A lubricating oil composition for a timepiece was prepared by further using the viscosity index improver (D) in the lubricating oil composition for a timepiece of Example 3-1-1.

Specifically, as the ether oil (A-3) of the base oil (A1), an alkyl-substituted diphenyl ether (trade name: MORESCO-HILUBE LB32, available from MATSUMURA OIL Co., Ltd.) was used, and to 100 parts of the base oil were added 5 parts of 4,4'-butylidenebis(3-methyl-6-t-butylphenyl ditridecyl phosphate) as the neutral phosphate ester (B-1) of the antiwear agent (B), 0.5 part of a diphenylamine derivative (IRGANOX L57 (trade name), available from Ciba Specialty Chemicals Inc.) as the antioxidant (C), and 5 parts of polyisobutylene as the viscosity index improver (D), to prepare a lubricating oil composition for a timepiece.

The number-average molecular weight of polyisobutylene, as measured by GPC, was 3700.

Example 3-13

A lubricating oil composition for a timepiece was prepared by further using the viscosity index improver (D) in the lubricating oil composition for a timepiece of Example 3-6-1.

Specifically, first, 12-hydroxystearic acid and an alkyl-substituted diphenyl ether (trade name: MORESCO-HILUBE LB32, available from MATSUMURA OIL Co., Ltd.) were put in a container, and heated. In the container, an aqueous LiOH solution was put, the resultant was dehydrated while being continuously warmed to be allowed to react, and was further warmed, and an alkyl-substituted diphenyl ether was input. An alkyl-substituted diphenyl ether was added to adjust a consistency to 200 with a three-roll mill, and a mixture of a derivative of lithium stearate with an alkyl-substituted diphenyl ether was obtained.

Then, 4,4'-butylidenebis(3-methyl-6-t-butylphenyl ditridecyl phosphite) as the neutral phosphite ester (B-2) and a diphenylamine derivative (IRGANOX L57 (trade name), available from Ciba Specialty Chemicals Inc.) as the antioxidant (C) were added to the mixture, to prepare a lubricating oil composition for a timepiece. Each component was adjusted and added so that the lubricating oil composition contains 5 parts of the neutral phosphite ester (B-2), 0.5 part of the antioxidant (C), and 5 parts of the above lithium 12-hydroxystearate as the viscosity index improver (D), based on 100 parts of the ether oil (A-3).

Example 3-14

A lubricating oil composition for a timepiece was prepared by further using the viscosity index improver (D) in the lubricating oil composition for a timepiece of Example 3-6-1.

Specifically, as the ether oil (A-3) of the base oil (A1), an alkyl-substituted diphenyl ether (trade name: MORESCO-HILUBE LB32, available from MATSUMURA OIL Co., Ltd.) was used, and to 100 parts of the base oil were added 5 parts of 4,4'-butylidenebis(3-methyl-6-t-butylphenyl ditridecyl phosphite) as the neutral phosphite ester (B-2) of the antiwear agent (B), 0.5 part of a diphenylamine derivative (IRGANOX L57 (trade name), available from Ciba Specialty Chemicals Inc.) as the antioxidant (C), and 5 parts of polyisobutylene as the viscosity index improver (D), to prepare a lubricating oil composition for a timepiece.

The number-average molecular weight of polyisobutylene, as measured by GPC, was 3700.

Example 3-15

A lubricating oil composition for a timepiece was prepared by further using the metal deactivator (E) in the lubricating oil composition for a timepiece of Example 3-1-1.

Specifically, as the ether oil (A-3) of the base oil (A1), an alkyl-substituted diphenyl ether (trade name: MORESCO-HILUBE LB32, available from MATSUMURA OIL Co., Ltd.) was used, and to 100 parts of the base oil were added 5 parts of 4,4'-butylidenebis(3-methyl-6-t-butylphenyl ditridecyl phosphate) as the neutral phosphate ester (B-1) of the antiwear agent (B), 0.5 part of a diphenylamine derivative (IRGANOX L57 (trade name), available from Ciba Specialty Chemicals Inc.) as the antioxidant (C), and 0.05 part of benzotriazole as the metal deactivator (E), to prepare a lubricating oil composition for a timepiece.

Example 3-16

A lubricating oil composition for a timepiece was prepared by further using the metal deactivator (E) in the lubricating oil composition for a timepiece of Example 3-6-1.

Specifically, as the ether oil (A-3) of the base oil (A1), an alkyl-substituted diphenyl ether (trade name: MORESCO-HILUBE LB32, available from MATSUMURA OIL Co., Ltd.) was used, and to 100 parts of the base oil were added 5 parts of 4,4'-butylidenebis(3-methyl-6-t-butylphenyl ditridecyl phosphite) as the neutral phosphite ester (B-2) of the antiwear agent (B), 0.5 part of a diphenylamine derivative (IRGANOX L57 (trade name), available from Ciba Specialty Chemicals Inc.) as the antioxidant (C), and 0.05 part of benzotriazole as the metal deactivator (E), to prepare a lubricating oil composition for a timepiece.

Comparative Example 1-1

A lubricating oil composition for a timepiece was prepared in the same manner as in Example 1-1-1, except that tricresyl phosphate was used instead of 4,4'-butylidenebis(3-methyl-6-t-butylphenyl ditridecyl phosphate) as the antiwear agent.

Comparative Example 1-2

A lubricating oil composition for a timepiece was prepared in the same manner as in Example 1-6-1, except that trioleyl phosphite was used instead of 4,4'-butylidenebis(3-methyl-6-t-butylphenyl ditridecyl phosphite) as the antiwear agent.

Comparative Example 2-1

A lubricating oil composition for a timepiece was prepared in the same manner as in Comparative Example 1-1, except that a neopentyl glycol/caprylic acid capric acid mixed ester (kinematic viscosity at −30° C.=less than 2000 cSt) was used as the polyol ester (A-1) instead of a trimer of 1-decene that was the paraffin-based hydrocarbon oil (A-2) of the base oil (A1).

Comparative Example 2-2

A lubricating oil composition for a timepiece was prepared in the same manner as in Comparative Example 1-2, except that a neopentyl glycol/caprylic acid capric acid mixed ester (kinematic viscosity at −30° C.=less than 2000 cSt) was used as the polyol ester (A-1) instead of a trimer of 1-decene that was the paraffin-based hydrocarbon oil (A-2) of the base oil (A1).

Comparative Example 3-1

A lubricating oil composition for a timepiece was prepared in the same manner as in Comparative Example 1-1, except that an alkyl-substituted diphenyl ether (trade name: MORESCO-HILUBE LB32, available from MATSUMURA OIL Co., Ltd.) was used as the ether oil (A-3) instead of a trimer of 1-decene that was the paraffin-based hydrocarbon oil (A-2) of the base oil (A1).

Comparative Example 3-2

A lubricating oil composition for a timepiece was prepared in the same manner as in Comparative Example 1-2, except that an alkyl-substituted diphenyl ether (trade name: MORESCO-HILUBE LB32, available from MATSUMURA OIL Co., Ltd.) was used as the ether oil (A-3) instead of a trimer of 1-decene that was the paraffin-based hydrocarbon oil (A-2) of the base oil (A1).

<Method for Evaluation Test 1>

[Four-Ball Test]

A four-ball test was conducted according to ASTM-D2783, and wear track diameters were measured with varying loads. Loads in cases in which marked wear started were also determined.

[Timepiece Operating Test (1)]

With regard to Citizen Watch Movement™ (No. 9015) that was a mechanical timepiece, the above-prepared lubricating oil composition for a timepiece was applied to the wheel train part (made of Fe-based alloy) that was a sliding part. This timepiece was continuously operated for 1000 hours under the conditions of −30° C., −10° C., ordinary temperature (25° C.), 80° C., and a humidity of 95% at 45° C. Before and after the test, the sliding part was observed. Specifically, the portions of the sliding part, to which pressures of 8700 N/m$^2$, 7960 N/m$^2$ and 7465 N/m$^2$ had been applied, respectively, were observed. Under any of the above conditions, the test was carried out using 20 samples.

The observation results were evaluated by the criteria described later.

[Timepiece Operating Test (2)]

With regard to Citizen Watch Movement™ (No. 9015) that was a mechanical timepiece, the above-prepared lubricating oil composition for a timepiece was applied to the wheel train part (made of Fe-based alloy) that was a sliding part. This timepiece was subjected to a durability test of 20 years' hands-turning at a rate that was 64 times the normal rate and at ordinary temperature. Before and after the test, the sliding part was observed. Specifically, the portions of the sliding part, to which pressures of 8700 N/m$^2$, 7960 N/m$^2$ and 7465 N/m$^2$ had been applied, respectively, were observed. The test was carried out using 20 samples.

The observation results were evaluated by the criteria described later.

[Timepiece Operating Test (3)]

With regard to Citizen Watch Movement™ (No. 9015) that was a mechanical timepiece, the above-prepared lubricating oil composition for a timepiece was applied to the wheel train part (made of Cu-based alloy) that was a sliding part. This timepiece was continuously operated for 1000 hours at ordinary temperature. Before and after the operation, the sliding part was observed. Specifically, the portions of the sliding part, to which pressures of 8700 N/m$^2$, 7960 N/m$^2$ and 7465 N/m$^2$ had been applied, respectively, were observed. The test was carried out using 20 samples.

The observation results were evaluated by the criteria described later.

[Criteria of Evaluation]

4A: At all of the portions to which pressures of 8700 N/m$^2$, 7960 N/m$^2$ and 7465 N/m$^2$ had been applied, neither color change nor signs of being worn were observed after the test.

3A: At the portion to which a pressure of 8700 N/m$^2$ had been applied, signs of being worn were observed though color change was not observed. At the portions to which pressures of 7960 N/m$^2$ and 7465 N/m$^2$ had been applied, neither color change nor signs of being worn were observed after the test.

2A: At the portions to which pressures of 8700 N/m$^2$ and 7960 N/m$^2$ had been applied, signs of being worn were observed though color change was not observed. At the portion to which a pressure of 7465 N/m$^2$ had been applied, neither color change nor signs of being worn were observed after the test.

A: At the portion to which a pressure of 8700 N/m$^2$ had been applied, the color changed to light brown, the surface was worn, and worn powder was observed. At the portion to which a pressure of 7960 N/m$^2$ had been applied, signs of being worn were observed though color change was not observed. At the portion to which a pressure of 7465 N/m$^2$ had been applied, neither color change nor signs of being worn were observed after the test.

B: At the portion to which a pressure of 8700 N/m$^2$ had been applied, the color changed to dark brown, the surface was conspicuously worn, and a large quantity of worn powder was observed. At the portion to which a pressure of 7960 N/m$^2$ had been applied, the color changed to light brown, the surface was worn, and worn powder was observed. At the portion to which a pressure of 7465 N/m$^2$ had been applied, signs of being worn were observed though color change was not observed.

C: At all of the portions to which pressures of 8700 N/m$^2$, 7960 N/m$^2$ and 7465 N/m$^2$ had been applied, the color changed to dark brown, the surface was conspicuously worn, and a large quantity of worn powder was observed.

<Results 1 of Evaluation Test>

[Results of Four-Ball Test]

With regard to the lubricating oil compositions prepared in Example 1-6-1 and Comparative Example 1-2, the evaluation results of the four-ball test are set forth in Table 7 below.

TABLE 7

| | Load (N) in case in which marked wear started | Wear track diameter (mm) |
|---|---|---|
| Example 1-6-1 | 785 | 4.95 |
| Comparative Example 1-2 | 618 | 5.39 |

[Results of Timepiece Operating Test]

Evaluation results of the timepiece operating test that was performed on the lubricating oil compositions prepared as previously described are set forth in the following tables.

TABLE 8

| | Timepiece operating test (1) 1000 hours Wheel train part: made of Fe-based alloy | | | | | Timepiece operating test (2) 20 years Wheel train part: made of | Timepiece operating test (3) 1000 hours Wheel train part: made of |
|---|---|---|---|---|---|---|---|
| Example | −30° C. | −10° C. | Ordinary temperature | 80° C. | 45° C. Humidity: 95% | Fe-based alloy Ordinary temperature | Cu-based alloy Ordinary temperature |
| 1-1-1 | 4A | 4A | 4A | 2A | 2A | 2A | A |
| 1-1-2 | 4A | 4A | 4A | 2A | 2A | 2A | A |
| 1-1-3 | 4A | 4A | 4A | 2A | 2A | 2A | A |
| 1-1-4 | 4A | 4A | 4A | 2A | 2A | 2A | A |
| 1-1-5 | 4A | 4A | 4A | 2A | 2A | 2A | A |
| 1-2-1 | 4A | 4A | 4A | 2A | 2A | 2A | A |
| 1-2-2 | 4A | 4A | 4A | 2A | 2A | 2A | A |
| 1-2-3 | 4A | 4A | 4A | 2A | 2A | 2A | A |
| 1-2-4 | 4A | 4A | 4A | 2A | 2A | 2A | A |

TABLE 8-continued

| Example | Timepiece operating test (1) 1000 hours Wheel train part: made of Fe-based alloy | | | | | Timepiece operating test (2) 20 years Wheel train part: made of Fe-based alloy | Timepiece operating test (3) 1000 hours Wheel train part: made of Cu-based alloy |
|---|---|---|---|---|---|---|---|
| | −30° C. | −10° C. | Ordinary temperature | 80° C. | 45° C. Humidity: 95% | Ordinary temperature | Ordinary temperature |
| 1-2-5 | 4A | 4A | 4A | 2A | 2A | 2A | A |
| 1-2-6 | 4A | 4A | 4A | 2A | 2A | A | A |
| 1-3-1 | 4A | 4A | 4A | 4A | 4A | 3A | A |
| 1-3-2 | 4A | 4A | 4A | 4A | 4A | 3A | A |
| 1-3-3 | 4A | 4A | 4A | 4A | 4A | 3A | A |
| 1-4-1 | 4A | 4A | 4A | 3A | 3A | 3A | A |
| 1-4-2 | 4A | 4A | 4A | 3A | 3A | 3A | A |
| 1-4-3 | 4A | 4A | 4A | 3A | 3A | 3A | A |
| 1-4-4 | 4A | 4A | 4A | 4A | 4A | 3A | A |
| 1-4-5 | 4A | 4A | 4A | 4A | 4A | 3A | A |
| 1-4-6 | 4A | 4A | 4A | 4A | 4A | 3A | A |
| 1-5-1 | 4A | 4A | 4A | 4A | 4A | 3A | A |
| 1-5-2 | 4A | 4A | 4A | 4A | 4A | 3A | A |
| 1-5-3 | 4A | 4A | 4A | 4A | 4A | 3A | A |
| 1-5-4 | 4A | 4A | 4A | 4A | 4A | 3A | A |

TABLE 9

| Example | Timepiece operating test (1) 1000 hours Wheel train part: made of Fe-based alloy | | | | | Timepiece operating test (2) 20 years Wheel train part: made of Fe-based alloy | Timepiece operating test (3) 1000 hours Wheel train part: made of Cu-based alloy |
|---|---|---|---|---|---|---|---|
| | −30° C. | −10° C. | Ordinary temperature | 80° C. | 45° C. Humidity: 95% | Ordinary temperature | Ordinary temperature |
| 1-6-1 | 4A | 4A | 4A | 2A | 2A | 3A | A |
| 1-6-2 | 4A | 4A | 4A | 2A | 2A | 3A | A |
| 1-6-3 | 4A | 4A | 4A | 2A | 2A | 3A | A |
| 1-6-4 | 4A | 4A | 4A | 2A | 2A | 3A | A |
| 1-6-5 | 4A | 4A | 4A | 2A | 2A | 3A | A |
| 1-7-1 | 4A | 4A | 4A | 2A | 2A | 3A | A |
| 1-7-2 | 4A | 4A | 4A | 2A | 2A | 3A | A |
| 1-7-3 | 4A | 4A | 4A | 2A | 2A | 3A | A |
| 1-7-4 | 4A | 4A | 4A | 2A | 2A | 3A | A |
| 1-7-5 | 4A | 4A | 4A | 2A | 2A | 3A | A |
| 1-7-6 | 4A | 4A | 4A | 2A | 2A | 2A | A |
| 1-8-1 | 4A | 4A | 4A | 4A | 4A | 4A | A |
| 1-8-2 | 4A | 4A | 4A | 4A | 4A | 4A | A |
| 1-8-3 | 4A | 4A | 4A | 4A | 4A | 4A | A |
| 1-9-1 | 4A | 4A | 4A | 3A | 3A | 4A | A |
| 1-9-2 | 4A | 4A | 4A | 3A | 3A | 4A | A |
| 1-9-3 | 4A | 4A | 4A | 3A | 3A | 4A | A |
| 1-9-4 | 4A | 4A | 4A | 4A | 4A | 4A | A |
| 1-9-5 | 4A | 4A | 4A | 4A | 4A | 4A | A |
| 1-9-6 | 4A | 4A | 4A | 4A | 4A | 4A | A |
| 1-10-1 | 4A | 4A | 4A | 4A | 4A | 4A | A |
| 1-10-2 | 4A | 4A | 4A | 4A | 4A | 4A | A |
| 1-10-3 | 4A | 4A | 4A | 4A | 4A | 4A | A |
| 1-10-4 | 4A | 4A | 4A | 4A | 4A | 4A | A |

TABLE 10

| Example | Timepiece operating test (1) 1000 hours Wheel train part: made of Fe-based alloy | | | | | Timepiece operating test (2) 20 years Wheel train part: made of Fe-based alloy | Timepiece operating test (3) 1000 hours Wheel train part: made of Cu-based alloy |
|---|---|---|---|---|---|---|---|
| | −30° C. | −10° C. | Ordinary temperature | 80° C. | 45° C. Humidity: 95% | Ordinary temperature | Ordinary temperature |
| 1-11 | 4A | 4A | 4A | 3A | 3A | 3A | A |
| 1-12 | 4A | 4A | 4A | 3A | 3A | 3A | A |
| 1-13 | 4A | 4A | 4A | 3A | 3A | 4A | A |
| 1-14 | 4A | 4A | 4A | 3A | 3A | 4A | A |
| 1-15 | 4A | 4A | 4A | 2A | 2A | 2A | 2A |
| 1-16 | 4A | 4A | 4A | 2A | 2A | 3A | 2A |

TABLE 11

| Example | Timepiece operating test (1) 1000 hours Wheel train part: made of Fe-based alloy | | | | | Timepiece operating test (2) 20 years Wheel train part: made of Fe-based alloy | Timepiece operating test (3) 1000 hours Wheel train part: made of Cu-based alloy |
|---|---|---|---|---|---|---|---|
| | −30° C. | −10° C. | Ordinary temperature | 80° C. | 45° C. Humidity: 95% | Ordinary temperature | Ordinary temperature |
| 2-1-1 | 4A | 4A | 4A | 2A | 2A | 2A | A |
| 2-1-2 | 4A | 4A | 4A | 2A | 2A | 2A | A |
| 2-1-3 | 4A | 4A | 4A | 2A | 2A | 2A | A |
| 2-1-4 | 4A | 4A | 4A | 2A | 2A | 2A | A |
| 2-1-5 | 4A | 4A | 4A | 2A | 2A | 2A | A |
| 2-2-1 | 4A | 4A | 4A | 2A | 2A | 2A | A |
| 2-2-2 | 4A | 4A | 4A | 2A | 2A | 2A | A |
| 2-2-3 | 4A | 4A | 4A | 2A | 2A | 2A | A |
| 2-2-4 | 4A | 4A | 4A | 2A | 2A | 2A | A |
| 2-2-5 | 4A | 4A | 4A | 2A | 2A | 2A | A |
| 2-2-6 | 4A | 4A | 4A | 2A | 2A | A | A |
| 2-3-1 | 4A | 4A | 4A | 4A | 4A | 3A | A |
| 2-3-2 | 4A | 4A | 4A | 4A | 4A | 3A | A |
| 2-3-3 | 4A | 4A | 4A | 4A | 4A | 3A | A |
| 2-4-1 | 4A | 4A | 4A | 3A | 3A | 3A | A |
| 2-4-2 | 4A | 4A | 4A | 3A | 3A | 3A | A |
| 2-4-3 | 4A | 4A | 4A | 3A | 3A | 3A | A |
| 2-4-4 | 4A | 4A | 4A | 4A | 4A | 3A | A |
| 2-4-5 | 4A | 4A | 4A | 4A | 4A | 3A | A |
| 2-4-6 | 4A | 4A | 4A | 4A | 4A | 3A | A |
| 2-5-1 | 4A | 4A | 4A | 4A | 4A | 3A | A |
| 2-5-2 | 4A | 4A | 4A | 4A | 4A | 3A | A |
| 2-5-3 | 4A | 4A | 4A | 4A | 4A | 3A | A |
| 2-5-4 | 4A | 4A | 4A | 4A | 4A | 3A | A |

TABLE 12

| Example | Timepiece operating test (1) 1000 hours Wheel train part: made of Fe-based alloy | | | | | Timepiece operating test (2) 20 years Wheel train part: made of Fe-based alloy | Timepiece operating test (3) 1000 hours Wheel train part: made of Cu-based alloy |
|---|---|---|---|---|---|---|---|
| | −30° C. | −10° C. | Ordinary temperature | 80° C. | 45° C. Humidity: 95% | Ordinary temperature | Ordinary temperature |
| 2-6-1 | 4A | 4A | 4A | 2A | 2A | 3A | A |
| 2-6-2 | 4A | 4A | 4A | 2A | 2A | 3A | A |
| 2-6-3 | 4A | 4A | 4A | 2A | 2A | 3A | A |
| 2-6-4 | 4A | 4A | 4A | 2A | 2A | 3A | A |
| 2-6-5 | 4A | 4A | 4A | 2A | 2A | 3A | A |
| 2-7-1 | 4A | 4A | 4A | 2A | 2A | 3A | A |

TABLE 12-continued

| Example | Timepiece operating test (1) 1000 hours Wheel train part: made of Fe-based alloy | | | | | Timepiece operating test (2) 20 years Wheel train part: made of Fe-based alloy | Timepiece operating test (3) 1000 hours Wheel train part: made of Cu-based alloy |
|---|---|---|---|---|---|---|---|
| | −30° C. | −10° C. | Ordinary temperature | 80° C. | 45° C. Humidity: 95% | Ordinary temperature | Ordinary temperature |
| 2-7-2 | 4A | 4A | 4A | 2A | 2A | 3A | A |
| 2-7-3 | 4A | 4A | 4A | 2A | 2A | 3A | A |
| 2-7-4 | 4A | 4A | 4A | 2A | 2A | 3A | A |
| 2-7-5 | 4A | 4A | 4A | 2A | 2A | 3A | A |
| 2-7-6 | 4A | 4A | 4A | 2A | 2A | 2A | A |
| 2-8-1 | 4A | 4A | 4A | 4A | 4A | 4A | A |
| 2-8-2 | 4A | 4A | 4A | 4A | 4A | 4A | A |
| 2-8-3 | 4A | 4A | 4A | 4A | 4A | 4A | A |
| 2-9-1 | 4A | 4A | 4A | 3A | 3A | 4A | A |
| 2-9-2 | 4A | 4A | 4A | 3A | 3A | 4A | A |
| 2-9-3 | 4A | 4A | 4A | 3A | 3A | 4A | A |
| 2-9-4 | 4A | 4A | 4A | 4A | 4A | 4A | A |
| 2-9-5 | 4A | 4A | 4A | 4A | 4A | 4A | A |
| 2-9-6 | 4A | 4A | 4A | 4A | 4A | 4A | A |
| 2-10-1 | 4A | 4A | 4A | 4A | 4A | 4A | A |
| 2-10-2 | 4A | 4A | 4A | 4A | 4A | 4A | A |
| 2-10-3 | 4A | 4A | 4A | 4A | 4A | 4A | A |
| 2-10-4 | 4A | 4A | 4A | 4A | 4A | 4A | A |

TABLE 13

| Example | Timepiece operating test (1) 1000 hours Wheel train part: made of Fe-based alloy | | | | | Timepiece operating test (2) 20 years Wheel train part: made of Fe-based alloy | Timepiece operating test (3) 1000 hours Wheel train part: made of Cu-based alloy |
|---|---|---|---|---|---|---|---|
| | −30° C. | −10° C. | Ordinary temperature | 80° C. | 45° C. Humidity: 95% | Ordinary temperature | Ordinary temperature |
| 2-11 | 4A | 4A | 4A | 3A | 3A | 3A | A |
| 2-12 | 4A | 4A | 4A | 3A | 3A | 3A | A |
| 2-13 | 4A | 4A | 4A | 3A | 3A | 4A | A |
| 2-14 | 4A | 4A | 4A | 3A | 3A | 4A | A |
| 2-15 | 4A | 4A | 4A | 2A | 2A | 2A | 2A |
| 2-16 | 4A | 4A | 4A | 2A | 2A | 3A | 2A |

TABLE 14

| Example | Timepiece operating test (1) 1000 hours Wheel train part: made of Fe-based alloy | | | | | Timepiece operating test (2) 20 years Wheel train part: made of Fe-based alloy | Timepiece operating test (3) 1000 hours Wheel train part: made of Cu-based alloy |
|---|---|---|---|---|---|---|---|
| | −30° C. | −10° C. | Ordinary temperature | 80° C. | 45° C. Humidity: 95% | Ordinary temperature | Ordinary temperature |
| 3-1-1 | 4A | 4A | 4A | 2A | 2A | 2A | A |
| 3-1-2 | 4A | 4A | 4A | 2A | 2A | 2A | A |
| 3-1-3 | 4A | 4A | 4A | 2A | 2A | 2A | A |
| 3-1-4 | 4A | 4A | 4A | 2A | 2A | 2A | A |
| 3-1-5 | 4A | 4A | 4A | 2A | 2A | 2A | A |
| 3-2-1 | 4A | 4A | 4A | 2A | 2A | 2A | A |
| 3-2-2 | 4A | 4A | 4A | 2A | 2A | 2A | A |
| 3-2-3 | 4A | 4A | 4A | 2A | 2A | 2A | A |
| 3-2-4 | 4A | 4A | 4A | 2A | 2A | 2A | A |
| 3-2-5 | 4A | 4A | 4A | 2A | 2A | 2A | A |
| 3-2-6 | 4A | 4A | 4A | 2A | 2A | A | A |
| 3-3-1 | 4A | 4A | 4A | 4A | 4A | 3A | A |

TABLE 14-continued

| Example | Timepiece operating test (1) 1000 hours Wheel train part: made of Fe-based alloy | | | | | Timepiece operating test (2) 20 years Wheel train part: made of Fe-based alloy | Timepiece operating test (3) 1000 hours Wheel train part: made of Cu-based alloy |
|---|---|---|---|---|---|---|---|
| | −30° C. | −10° C. | Ordinary temperature | 80° C. | 45° C. Humidity: 95% | Ordinary temperature | Ordinary temperature |
| 3-3-2 | 4A | 4A | 4A | 4A | 4A | 3A | A |
| 3-3-3 | 4A | 4A | 4A | 4A | 4A | 3A | A |
| 3-4-1 | 4A | 4A | 4A | 3A | 3A | 3A | A |
| 3-4-2 | 4A | 4A | 4A | 3A | 3A | 3A | A |
| 3-4-3 | 4A | 4A | 4A | 3A | 3A | 3A | A |
| 3-4-4 | 4A | 4A | 4A | 4A | 4A | 3A | A |
| 3-4-5 | 4A | 4A | 4A | 4A | 4A | 3A | A |
| 3-4-6 | 4A | 4A | 4A | 4A | 4A | 3A | A |
| 3-5-1 | 4A | 4A | 4A | 4A | 4A | 3A | A |
| 3-5-2 | 4A | 4A | 4A | 4A | 4A | 3A | A |
| 3-5-3 | 4A | 4A | 4A | 4A | 4A | 3A | A |
| 3-5-4 | 4A | 4A | 4A | 4A | 4A | 3A | A |

TABLE 15

| Example | Timepiece operating test (1) 1000 hours Wheel train part: made of Fe-based alloy | | | | | Timepiece operating test (2) 20 years Wheel train part: made of Fe-based alloy | Timepiece operating test (3) 1000 hours Wheel train part: made of Cu-based alloy |
|---|---|---|---|---|---|---|---|
| | −30° C. | −10° C. | Ordinary temperature | 80° C. | 45° C. Humidity: 95% | Ordinary temperature | Ordinary temperature |
| 3-6-1 | 4A | 4A | 4A | 2A | 2A | 3A | A |
| 3-6-2 | 4A | 4A | 4A | 2A | 2A | 3A | A |
| 3-6-3 | 4A | 4A | 4A | 2A | 2A | 3A | A |
| 3-6-4 | 4A | 4A | 4A | 2A | 2A | 3A | A |
| 3-6-5 | 4A | 4A | 4A | 2A | 2A | 3A | A |
| 3-7-1 | 4A | 4A | 4A | 2A | 2A | 3A | A |
| 3-7-2 | 4A | 4A | 4A | 2A | 2A | 3A | A |
| 3-7-3 | 4A | 4A | 4A | 2A | 2A | 3A | A |
| 3-7-4 | 4A | 4A | 4A | 2A | 2A | 3A | A |
| 3-7-5 | 4A | 4A | 4A | 2A | 2A | 3A | A |
| 3-7-6 | 4A | 4A | 4A | 2A | 2A | 2A | A |
| 3-8-1 | 4A | 4A | 4A | 4A | 4A | 4A | A |
| 3-8-2 | 4A | 4A | 4A | 4A | 4A | 4A | A |
| 3-8-3 | 4A | 4A | 4A | 4A | 4A | 4A | A |
| 3-9-1 | 4A | 4A | 4A | 3A | 3A | 4A | A |
| 3-9-2 | 4A | 4A | 4A | 3A | 3A | 4A | A |
| 3-9-3 | 4A | 4A | 4A | 3A | 3A | 4A | A |
| 3-9-4 | 4A | 4A | 4A | 4A | 4A | 4A | A |
| 3-9-5 | 4A | 4A | 4A | 4A | 4A | 4A | A |
| 3-9-6 | 4A | 4A | 4A | 4A | 4A | 4A | A |
| 3-10-1 | 4A | 4A | 4A | 4A | 4A | 4A | A |
| 3-10-2 | 4A | 4A | 4A | 4A | 4A | 4A | A |
| 3-10-3 | 4A | 4A | 4A | 4A | 4A | 4A | A |
| 3-10-4 | 4A | 4A | 4A | 4A | 4A | 4A | A |

TABLE 16

| Example | Timepiece operating test (1) 1000 hours Wheel train part: made of Fe-based alloy | | | | | Timepiece operating test (2) 20 years Wheel train part: made of | Timepiece operating test (3) 1000 hours Wheel train part: made of |
|---|---|---|---|---|---|---|---|
| | −30° C. | −10° C. | Ordinary temperature | 80° C. | 45° C. Humidity: 95% | Fe-based alloy Ordinary temperature | Cu-based alloy Ordinary temperature |
| 3-11 | 4A | 4A | 4A | 3A | 3A | 3A | A |
| 3-12 | 4A | 4A | 4A | 3A | 3A | 3A | A |
| 3-13 | 4A | 4A | 4A | 3A | 3A | 4A | A |
| 3-14 | 4A | 4A | 4A | 3A | 3A | 4A | A |
| 3-15 | 4A | 4A | 4A | 2A | 2A | 2A | 2A |
| 3-16 | 4A | 4A | 4A | 2A | 2A | 3A | 2A |

TABLE 17

| Comparative Example | Timepiece operating test (1) 1000 hours Wheel train part: made of Fe-based alloy | | | | | Timepiece operating test (2) 20 years Wheel train part: made of | Timepiece operating test (3) 1000 hours Wheel train part: made of |
|---|---|---|---|---|---|---|---|
| | −30° C. | −10° C. | Ordinary temperature | 80° C. | 45° C. Humidity: 95% | Fe-based alloy Ordinary temperature | Cu-based alloy Ordinary temperature |
| 1-1 | C | C | C | C | C | C | C |
| 1-2 | C | C | C | C | C | C | C |
| 2-1 | C | C | C | C | C | C | C |
| 2-2 | C | C | C | C | C | C | C |
| 3-1 | C | C | C | C | C | C | C |
| 3-2 | C | C | C | C | C | C | C |

The total acid numbers of the lubricating oil compositions prepared in the above examples and comparative examples were each not more than 0.2 mgKOH/g. With regard to the results of evaluation of the above examples and comparative examples, a difference among the samples was not observed.

Also in the cases where the antioxidants (C) used in Examples 1-1-1, 1-6-1, and 1-11 to 1-16 were changed to other antioxidants (C) set forth in the above Table 3, evaluation results similar to those of Examples 1-1-1, 1-6-1, and 1-11 to 1-16 were obtained. Further, also in the cases where the base oil (A-2) used in Examples 1-1-1, 1-6-1, and 1-11 to 1-16 was changed to another base oil (A-2) that was given as an example in the description of the base oil (A-2) of the aforesaid « Base oil (A1) », evaluation results similar to those of Examples 1-1-1, 1-6-1, and 1-11 to 1-16 were obtained, also in the cases where the base oil (A-1) used in Examples 2-1-1, 2-6-1, and 2-11 to 2-16 was changed to another base oil (A-1) that was given as an example in the description of the base oil (A-1) of the aforesaid « Base oil (A1) », evaluation results similar to those of Examples 2-1-1, 2-6-1, and 2-11 to 2-16 were obtained, and also in the cases where the base oil (A-3) used in Examples 3-1-1, 3-6-1, and 3-11 to 3-16 was changed to another base oil (A-3) that was given as an example in the description of the base oil (A-3) of the aforesaid « Base oil (A1) », evaluation results similar to those of Examples 3-1-1, 3-6-1, and 3-11 to 3-16 were obtained.

With regard to Example 1-6-1 and Comparative Example 1-2, appearances of the sliding parts observed after the timepiece operating test (1) (continuous operation for 1000 hours at ordinary temperature, portion to which a pressure of 7465 N/m$^2$ was applied during operation) are shown in FIGS. 1 and 2, respectively. In the case of Example 1-6-1, neither color change nor signs of being worn were observed after the test. On the other hand, in the case of Comparative Example 1-2, a deposit such as worn powder or rust was formed in the sliding part, and the color of the sliding part changed to dark brown.

<Preparation 2 of Lubricating Oil Composition for Timepiece>

In the following specific examples, the solid lubricant (A2) was used as the lubricant component (A) together with the base oil (A1).

Example 4-1-1

As the lubricant component (A), a lubricant component consisting of 70% by mass of a trimer of 1-decene, said trimer being the paraffin-based hydrocarbon oil (A-2) of the base oil (A1), and 30% by mass of polytetrafluoroethylene (available from Shamrock Technologies, mean particle diameter: not more than 1 μm) was used. To 100 parts of this lubricant component were added 5.4 parts of 4,4'-butylidenebis(3-methyl-6-t-butylphenyl ditridecyl phosphate) as the neutral phosphate ester (B-1) of the antiwear agent (B) and 0.5 part of a diphenylamine derivative (reaction product of diphenylamine with 2,4,4-trimethylpentene (reaction product: IRGANOX L57 (trade name), available from Ciba Specialty Chemicals Inc.)) as the antioxidant (C), to prepare a lubricating oil composition for a timepiece.

The kinematic viscosity of the above base oil at −30° C. was less than 2000 cSt, and the number of carbon atoms thereof was 30. On this account, the lubricating oil composition obtained by adding the components to the base oil had fluidity even at −30° C.

Examples 4-1-2 to 4-1-18, 5-1-1 to 5-1-4, 6-1-1 to 6-1-6, and 7-1-1 to 7-1-7

Lubricating oil compositions for timepieces were prepared in the same manner as in Example 4-1-1, except that the blending constitution of Example 4-1-1 was changed as shown in Table 18 to Table 20.

<Method for Evaluation Test 2>

[Timepiece Operating Test (4)]

With regard to Citizen Watch Movement™ (No. 82) that was a mechanical timepiece, the above-prepared lubricating oil composition for a timepiece or universal machinery grease "Orelube G-1/3" (available from The Orelube Corp. Japan) was applied to the mainspring in the barrel, said mainspring being a sliding part. Each timepiece was continuously operated for 1000 hours under each of the conditions of −30° C. and ordinary temperature (25° C.). The output during the test was measured by the use of a torque measuring instrument. Before and after the test, the sliding part was observed. Under any of the above conditions, the test was carried out using 20 samples.

The observation results were evaluated by the criteria described later.

[Timepiece Operating Test (5)]

With regard to Citizen Watch Movement™ (No. 82) that was a mechanical timepiece, the above-prepared lubricating oil composition for a timepiece was applied to the mainspring in the barrel, said mainspring being a sliding part. This timepiece was subjected to a durability test of 20 years' hands-turning at a rate that was 64 times the normal rate and at ordinary temperature. Before and after the test, the sliding part was observed. The test was carried out using 20 samples.

The observation results were evaluated by the criteria described later.

[Criteria of Evaluation]

In the timepiece operating test (4), a case where the output rose by not less than 30% as compared with the case where the universal machinery grease "Orelube G-1/3" (available from The Orelube Corp. Japan) was used as the lubricant for the mainspring at ordinary temperature (25° C.) was evaluated as "4A", a case where the output rose by not less than 20% but less than 30% was evaluated as "3A", a case where the output rose by not less than 10% but less than 20% was evaluated as "2A", and a case where the output rose by more than 0% but less than 10% was evaluated as "A". Here, on the basis of a proportion of a loss of generated torque to a force in the winding of the mainspring when the "Orelube G-1/3" was used, a ratio of this loss proportion reduced when the lubricating oil composition of the above example was used was regarded as an output rise ratio.

When the universal machinery grease "Orelube G-1/3" (available from The Orelube Corp. Japan) was used as the lubricant for the mainspring at −30° C. in the timepiece operating test (4), the grease was solidified, and the watch movement could not be operated. A case where the watch movement could be operated in contrast with this when the lubricating oil composition of the above example was used was evaluated as "A".

In the timepiece operating test (5), a case where neither color change nor signs of being worn were observed after the test at the mainspring part was evaluated as "2A", a case where color change was not observed but signs of being worn were observed was evaluated as "A", a case where the color changed to light brown, the surface was worn, and worn powder was observed was evaluated as "B", and a case where the color changed to dark brown, the surface was conspicuously worn, and a large quantity of worn powder was observed was evaluated as "C".

<Results 2 of Evaluation Test>

[Results of Timepiece Operating Tests (4) and (5)]

With regard to the lubricating oil compositions prepared as described above, blending constitutions and evaluation results of the timepiece operating tests (4) and (5) are set forth in the following tables.

TABLE 18

| Lubricating oil composition | | | Example 4-1 | | | | | | | | |
|---|---|---|---|---|---|---|---|---|---|---|---|
| | | | 1 | 2 | 3 | 4 | 5 | 6 | 7 | 8 | 9 |
| Lubricant component (A) | Base oil (A1) (% by mass) | A-2-1 | 70.0 | 60.0 | 51.4 | 45.9 | 40.5 | 30.0 | 70.0 | 60.0 | 51.4 |
| | | A-1-1 | | | | | | | | | |
| | | A-3-1 | | | | | | | | | |
| | Solid lubricant (A2) (% by mass) | polytetrafluoroethylene | 30.0 | 40.0 | 48.6 | 54.1 | 59.5 | 70.0 | | | |
| | | molybdenum disulfide | | | | | | | 30.0 | 40.0 | 48.6 |
| | | graphite powder | | | | | | | | | |
| | Lubricant component (A) (part(s) by mass) | | 100 | 100 | 100 | 100 | 100 | 100 | 100 | 100 | 100 |
| Antiwear agent (B) | Neutral phosphate ester (B-1) | 4,4'-butylidenebis(3-methyl-6-t-butylphenyl ditridecyl phosphate) | 5.4 | 5.4 | 5.4 | 5.4 | 5.4 | 5.4 | 5.4 | 5.4 | 5.4 |
| | Neutral phosphite ester (B-2) | 4,4'-butylidenebis(3-methyl-6-t-butylphenyl ditridecyl phosphite) | | | | | | | | | |
| Antioxidant (C) | Diphenylamine derivative (C-1) | IRGANOX L57 | 0.5 | 0.5 | 0.5 | 0.5 | 0.5 | 0.5 | 0.5 | 0.5 | 0.5 |
| Evaluation | | | | | | | | | | | |
| Timepiece operating test (4): output rise ratio (%) of a case of using the lubricating oil composition of each example to a case of using universal machinery grease "Orelube G-1/3" (available from The Orelube Corp. Japan) at ordinary temperature (25° C.) | | | 3A | 3A | 4A | 4A | 4A | 2A | 2A | 3A | 4A |

TABLE 18-continued

| | | | | | | | | | | |
|---|---|---|---|---|---|---|---|---|---|---|
| Timepiece operating test (4): −30° C. | | | A | A | A | A | A | A | A | A | A |
| Timepiece operating test (5): 20 years, mainspring part in barrel | | | 2A | 2A | 2A | 2A | 2A | A | A | 2A | 2A |

| Lubricating oil composition | | | Example 4-1 | | | | | | | | |
|---|---|---|---|---|---|---|---|---|---|---|---|
| | | | 10 | 11 | 12 | 13 | 14 | 15 | 16 | 17 | 18 |
| Lubricant component (A) | Base oil (A1) (% by mass) | A-2-1 | 45.9 | 40.5 | 30.0 | 70.0 | 60.0 | 51.4 | 45.9 | 40.5 | 30.0 |
| | | A-1-1 | | | | | | | | | |
| | | A-3-1 | | | | | | | | | |
| | Solid lubricant (A2) (% by mass) | polytetrafluoroethylene | | | | | | | | | |
| | | molybdenum disulfide | 54.1 | 59.5 | 70.0 | | | | | | |
| | | graphite powder | | | | 30.0 | 40.0 | 48.6 | 54.1 | 59.5 | 70.0 |
| | Lubricant component (A) (part(s) by mass) | | 100 | 100 | 100 | 100 | 100 | 100 | 100 | 100 | 100 |
| Antiwear agent (B) | Neutral phosphate ester (B-1) | 4,4'-butylidenebis(3-methyl-6-t-butylphenyl ditridecyl phosphate) | 5.4 | 5.4 | 5.4 | 5.4 | 5.4 | 5.4 | 5.4 | 5.4 | 5.4 |
| | Neutral phosphite ester (B-2) | 4,4'-butylidenebis(3-methyl-6-t-butylphenyl ditridecyl phosphite) | | | | | | | | | |
| Antioxidant (C) | Diphenylamine derivative (C-1) | IRGANOX L57 | 0.5 | 0.5 | 0.5 | 0.5 | 0.5 | 0.5 | 0.5 | 0.5 | 0.5 |
| Evaluation | | | | | | | | | | | |
| Timepiece operating test (4): output rise ratio (%) of a case of using the lubricating oil composition of each example to a case of using universal machinery grease "Orelube G-1/3" (available from The Orelube Corp. Japan) at ordinary temperature (25° C.) | | | 4A | 4A | 2A | 2A | 2A | 3A | 3A | 3A | 2A |
| Timepiece operating test (4): −30° C. | | | A | A | A | A | A | A | A | A | A |
| Timepiece operating test (5): 20 years, mainspring part in barrel | | | 2A | 2A | A | A | A | 2A | 2A | 2A | A |

A-2-1: trimer of 1-decene

A-1-1: neopentyl glycol/caprylic acid capric acid mixed ester (kinematic viscosity at −30° C. = less than 2000 cSt)

A-3-1: alkyl-substituted diphenyl ether (trade name: MORESCO-HILUBE LB32, available from MATSUMURA OIL Co., Ltd.)

polytetrafluoroethylene (mean particle diameter: not more than 1 μm)

molybdenum disulfide (mean particle diameter: 1.4 μm)

graphite powder (mean particle diameter: 4 μm)

TABLE 19

| Lubricating oil composition | | | Example 5-1 | | | | Example 6-1 | | | | | |
|---|---|---|---|---|---|---|---|---|---|---|---|---|
| | | | 1 | 2 | 3 | 4 | 1 | 2 | 3 | 4 | 5 | 6 |
| Lubricant component (A) | Base oil (A1) (% by mass) | A-2-1 | 51.4 | 51.4 | 51.4 | 51.4 | | | | | | |
| | | A-1-1 | | | | | 51.4 | 45.9 | 40.5 | | | |
| | | A-3-1 | | | | | | | | 51.4 | 45.9 | 40.5 |
| | Solid lubricant (A2) (% by mass) | polytetrafluoroethylene | 48.6 | 48.6 | 48.6 | 48.6 | 48.6 | 54.1 | 59.5 | 48.6 | 54.1 | 59.5 |
| | | molybdenum disulfide | | | | | | | | | | |
| | | graphite powder | | | | | | | | | | |
| | Lubricant component (A) (part(s) by mass) | | 100 | 100 | 100 | 100 | 100 | 100 | 100 | 100 | 100 | 100 |
| Antiwear agent (B) | Neutral phosphate ester (B-1) | 4,4'-butylidenebis(3-methyl-6-t-butylphenyl ditridecyl phosphate) | 0.1 | 8.0 | 5.4 | 5.4 | 5.4 | 5.4 | 5.4 | 5.4 | 5.4 | 5.4 |
| | Neutral phosphite ester (B-2) | 4,4'-butylidenebis(3-methyl-6-t-butylphenyl ditridecyl phosphite) | | | | | | | | | | |
| Antioxidant (C) | Diphenylamine derivative (C-1) | IRGANOX L57 | 0.5 | 0.5 | 0.01 | 3.0 | 0.5 | 0.5 | 0.5 | 0.5 | 0.5 | 0.5 |
| Evaluation | | | | | | | | | | | | |
| Timepiece operating test (4): output rise ratio (%) of a case of using the lubricating oil composition of each example to a case of using universal machinery grease "Orelube G-1/3" (available from The Orelube Corp. Japan) at ordinary temperature (25° C.) | | | 2A | 4A | 4A | 4A | 4A | 4A | 4A | 4A | 4A | 4A |

TABLE 19-continued

| Lubricating oil composition | Example 5-1 | | | | Example 6-1 | | | | | |
|---|---|---|---|---|---|---|---|---|---|---|
| | 1 | 2 | 3 | 4 | 1 | 2 | 3 | 4 | 5 | 6 |
| Timepiece operating test (4): −30° C. | A | A | A | A | A | A | A | A | A | A |
| Timepiece operating test (5): 20 years, mainspring part in barrel | 2A | 2A | A | 2A | 2A | 2A | 2A | 2A | 2A | 2A |

A-2-1: trimer of 1-decene
A-1-1: neopentyl glycol/caprylic acid capric acid mixed ester (kinematic viscosity at −30° C. = less than 2000 cSt)
A-3-1: alkyl-substituted diphenyl ether (trade name: MORESCO-HILUBE LB32, available from MATSUMURA OIL Co., Ltd.)
polytetrafluoroethylene (mean particle diameter: not more than 1 μm)
molybdenum disulfide (mean particle diameter: 1.4 μm)
graphite powder (mean particle diameter: 4 μm)

TABLE 20

| Lubricating oil composition | | | Example 7-1 | | | | | | |
|---|---|---|---|---|---|---|---|---|---|
| | | | 1 | 2 | 3 | 4 | 5 | 6 | 7 |
| Lubricant component (A) | Base oil (A1) (% by mass) | A-2-1 | 51.4 | 51.4 | 51.4 | 51.4 | 51.4 | 51.4 | 51.4 |
| | | A-1-1 | | | | | | | |
| | | A-3-1 | | | | | | | |
| | Solid lubricant (A2) (% by mass) | polytetrafluoroethylene | 48.6 | | | 48.6 | 48.6 | 48.6 | 48.6 |
| | | molybdenum disulfide | | 48.6 | | | | | |
| | | graphite powder | | | 48.6 | | | | |
| | Lubricant component (A) (part(s) bymass) | | 100 | 100 | 100 | 100 | 100 | 100 | 100 |
| Antiwear agent (B) | Neutral phosphate ester (B-1) | 4,4'-butylidenebis(3-methyl-6-t-butylphenyl ditridecyl phosphate) | | | | | | | |
| | Neutral phosphite ester (B-2) | 4,4'-butylidenebis(3-methyl-6-t-butylphenyl ditridecyl phosphite) | 5.4 | 5.4 | 5.4 | 0.1 | 8.0 | 5.4 | 5.4 |
| Antioxidant (C) | Diphenylamine derivative (C-1) | IRGANOX L57 | 0.5 | 0.5 | 0.5 | 0.5 | 0.5 | 0.01 | 3.0 |
| Evaluation | | | | | | | | | |
| Timepiece operating test (4): output rise ratio (%) of a case of using the lubricating oil composition of each example to a case of using universal machinery grease "Orelube G-1/3" (available from The Orelube Corp. Japan) at ordinary temperature (25° C.) | | | 4A | 4A | 3A | 2A | 4A | 4A | 4A |
| Timepiece operating test (4): −30° C. | | | A | A | A | A | A | A | A |
| Timepiece operating test (5): 20 years, mainspring part in barrel | | | 2A | 2A | 2A | 2A | 2A | A | 2A |

A-2-1: trimer of 1-decene
A-1-1: neopentyl glycol/caprylic acid capric acid mixed ester (kinematic viscosity at −30° C. = less than 2000 cSt)
A-3-1: alkyl-substituted diphenyl ether (trade name: MORESCO-HILUBE LB32, available from MATSUMURA OIL Co., Ltd.)
polytetrafluoroethylene (mean particle diameter: not more than 1 μm)
molybdenum disulfide (mean particle diameter: 1.4 μm)
graphite powder (mean particle diameter: 4 μm)

The total acid numbers of the lubricating oil compositions prepared in the above examples were each not more than 0.2 mgKOH/g. With regard to the results of evaluation of the above examples, a difference among the samples was not observed.

[Four-Ball Test]

A four-ball test was conducted according to ASTM-D2783, and loads in cases in which marked wear started and in which seizure started were determined.

[Results of Four-Ball Test]

With regard to the lubricating oil composition prepared in Example 4-1-3 and to the universal machinery grease "Orelube G-1/3" (available from The Orelube Corp. Japan), the evaluation results of the four-ball test is set forth in Table 20 below. The consistency (25° C.) of the lubricating oil composition of Example 4-1-3, based on JIS K 2220, was 320, whereas the consistency (25° C.) of "Orelube G-1/3" was 273.

TABLE 21

| | Load (N) in case in which marked wear started | Load (N) in case in which seizure started |
|---|---|---|
| Example 4-1-3 | 981 | 6080 |
| Orelube G-1/3 | 490 | 1961 |

The invention claimed is:

1. A lubricating oil composition for a timepiece, comprising a lubricant component (A) containing at least one base oil (A1) selected from a polyol ester (A-1), a paraffin-based hydrocarbon oil (A-2) having 25 or more carbon atoms and an ether oil (A-3), an antiwear agent (B) comprising a neutral phosphite ester (B-2), and an antioxidant (C), wherein the total acid number of the composition is not more than 0.8 mgKOH/g, the antiwear agent (B) is contained in an amount of 0.1 to 15 parts by mass based on 100 parts by mass of the lubricant component (A), and the antioxidant (C) is contained in an amount of 0.01 to 3 parts by mass based on 100 parts by mass of the lubricant component (A), and the neutral phosphite ester (B-2) is represented by the following general formula (b-2):

(b-2)

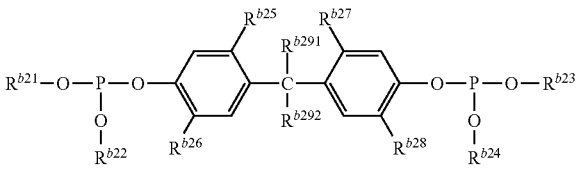

wherein $R^{b21}$ to $R^{b24}$ each independently represent an aliphatic hydrocarbon group of 10 to 16 carbon atoms, $R^{b25}$ to $R^{b28}$ each independently represent a straight-chain or branched alkyl group of 1 to 6 carbon atoms, $R^{b291}$ and $R^{b292}$ each independently represent a hydrogen atom or a straight-chain or branched alkyl group of 1 to 5 carbon atoms, and the total number of carbon atoms of $R^{b291}$ and $R^{b292}$ is 1 to 5.

2. The lubricating oil composition for a timepiece as claimed in claim 1, wherein the polyol ester (A-1) is a polyol ester having no hydroxyl group at a molecular end.

3. The lubricating oil composition for a timepiece as claimed in claim 1, wherein the ether oil (A-3) is represented by the following general formula (a-3):

$$R^{a31}—(—O—R^{a33}—)_n—R^{a32} \quad \text{(a-3)}$$

wherein $R^{a31}$ and $R^{a32}$ are each independently an alkyl group of 1 to 18 carbon atoms or a monovalent aromatic hydrocarbon group of 6 to 18 carbon atoms, $R^{a33}$ is an alkylene group of 1 to 18 carbon atoms or a divalent aromatic hydrocarbon group of 6 to 18 carbon atoms, and n is an integer of 1 to 5.

4. The lubricating oil composition for a timepiece as claimed in claim 1, wherein the antioxidant (C) is an amine-based antioxidant.

5. The lubricating oil composition for a timepiece as claimed in claim 1, wherein not less than 30% by mass of the lubricant component (A) is the base oil (A1).

6. The lubricating oil composition for a timepiece as claimed in claim 5, wherein the lubricant component (A) consists of the base oil (A1).

7. The lubricating oil composition for a timepiece as claimed in claim 5, wherein the lubricant component (A) comprises the base oil (A1) and a solid lubricant (A2).

8. The lubricating oil composition for a timepiece as claimed in claim 7, wherein the content of the base oil (A1) is 30 to 70% by mass and the content of the solid lubricant (A2) is 70 to 30% by mass, based on 100% by mass of the lubricant component (A).

9. The lubricating oil composition for a timepiece as claimed in claim 1, further comprising a viscosity index improver (D).

10. The lubricating oil composition for a timepiece as claimed in claim 9, wherein the viscosity index improver (D) is lithium stearate or a derivative of lithium stearate.

11. The lubricating oil composition for a timepiece as claimed in claim 9, wherein the viscosity index improver (D) is polyisobutylene.

12. The lubricating oil composition for a timepiece as claimed in claim 1, further comprising a metal deactivator (E).

13. The lubricating oil composition for a timepiece as claimed in claim 12, wherein the metal deactivator (E) is benzotriazole or a derivative thereof.

14. A timepiece comprising sliding parts having thereon the lubricating oil composition for a timepiece of claim 1.

* * * * *